US010386771B2

(12) United States Patent
Minamino et al.

(10) Patent No.: US 10,386,771 B2
(45) Date of Patent: Aug. 20, 2019

(54) IMAGE FORMING APPARATUS AND METHOD OF CONTROLLING IMAGE FORMING APPARATUS

(71) Applicant: KYOCERA Document Solutions Inc., Osaka (JP)

(72) Inventors: Koji Minamino, Osaka (JP); Hitoshi Asaka, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 124 days.

(21) Appl. No.: 15/611,751

(22) Filed: Jun. 1, 2017

(65) Prior Publication Data

US 2017/0357199 A1 Dec. 14, 2017

(30) Foreign Application Priority Data

Jun. 8, 2016 (JP) ..... 2016-114363
Jul. 22, 2016 (JP) ..... 2016-144423

(51) Int. Cl.
*G03G 15/00* (2006.01)
*B65H 1/26* (2006.01)
(Continued)

(52) U.S. Cl.
CPC ..... *G03G 15/6511* (2013.01); *B65H 1/266* (2013.01); *B65H 3/06* (2013.01); *B65H 3/44* (2013.01); *B65H 7/06* (2013.01); *G03G 15/55* (2013.01); *G03G 15/6502* (2013.01); *B65H 2511/414* (2013.01); *B65H 2511/51* (2013.01);
(Continued)

(58) Field of Classification Search
CPC ..... G03G 15/6511; G03G 15/55; G03G 15/6502; B65H 1/26; B65H 3/06; B65H 3/44; B65H 7/06; B65H 2511/414
See application file for complete search history.

(56) References Cited

U.S. PATENT DOCUMENTS 5,489,968 A * 2/1996 Rossbach ..... G03G 15/5012 399/20
9,193,548 B2 * 11/2015 Kobayashi ..... B65H 3/0684

FOREIGN PATENT DOCUMENTS

JP 2003-212362 A 7/2003
JP 2007-161376 A 6/2007
JP 2013035689 A * 2/2013

OTHER PUBLICATIONS

Machine Translation of Sugimoto, Feb. 2013.*
(Continued)

*Primary Examiner* — Matthew G Marini
(74) *Attorney, Agent, or Firm* — Stein IP, LLC

(57) ABSTRACT

An image forming apparatus includes a cassette that has a placement plate on which a sheet is set, a paper feed roller, a raising/lowering mechanism that raises and lowers the placement plate, a print unit, a sheet sensor, an upper limit sensor and a control unit. The control unit recognizes, based on an output of the sheet sensor, that the sheet supplied from a paper feed device reaches an installation position of the sheet sensor. The control unit detects, based on an output of the upper limit sensor, that the paper feed roller reaches a predetermined upper limit position or that the raising/lowering mechanism raises the placement plate such that the sheet reaches a feed position and uses the sheet sensor and the upper limit sensor so as to detect that the paper feed device encounters overload.

7 Claims, 11 Drawing Sheets

(51) Int. Cl.

| | |
|---|---|
| ***B65H 3/06*** | (2006.01) |
| ***B65H 3/44*** | (2006.01) |
| ***B65H 7/06*** | (2006.01) |

(52) U.S. Cl.
CPC ..... *B65H 2513/53* (2013.01); *B65H 2551/20* (2013.01); *B65H 2551/29* (2013.01); *B65H 2601/271* (2013.01); *G03G 15/70* (2013.01)

(56) References Cited

OTHER PUBLICATIONS

Japanese Office Action dated Mar. 5, 2019, issued by the Japanese Patent Office in corresponding application JP 2016-144423.

* cited by examiner

FIG.7

D1

| | REFERENCE TIME[ s ] | MARGIN[ s ] | DETERMINATION TIME[ s ] (REFERENCE TIME - MARGIN) |
|---|---|---|---|
| PAPER FEED DEVICE (UPPERMOST) | T1 | T1 | 0 |
| PAPER FEED DEVICE (MIDDLE) | T2 | m | t2 (T2-m) |
| PAPER FEED DEVICE (LOWERMOST) | T3 | m | t1 (T2-m) |

IMAGE FORMING APPARATUS AND METHOD OF CONTROLLING IMAGE FORMING APPARATUS

This application is based upon and claims the benefit of priority from the corresponding Japanese Patent Application No. 2016-114363 filed on Jun. 8, 2016 and the corresponding Japanese Patent Application No. 2016-144423 filed on Jul. 22, 2016, the entire contents of which are incorporated herein by reference.

BACKGROUND

The present disclosure relates to an image forming apparatus which includes a plurality of paper feed devices that are stacked.

Examples of an image forming apparatus include a multifunctional peripheral, a copying machine and a printer. The image forming apparatus includes a paper feed device. The paper feed device stores sheets which are used for printing. A user sets the sheets used for printing in the paper feed device. The paper feed device supplies the sheets one by one at the time of printing. There are paper feed devices which can set a plurality of sheets. However, there is an upper limit on the number of sheets which can be set in the paper feed device (the thickness of a sheet bundle). When the number of sheets set exceeds the upper limit, an error such as a paper jam or a non-paper feed jam is more likely to occur. The following technology on the excessive loading of sheets in a paper feed device is known.

Specifically, an image forming apparatus is disclosed which detects that a transfer member loading portion is raised to an upper limit position so as to perform an operation of feeding a transfer member, which includes overload determination means for the transfer member and which does not perform the feeding operation when an overload state is detected. In this configuration, paper bending or a paper jam is attempted to be avoided which easily occurs when the transfer members are loaded on the transfer member loading portion beyond a paper feed limit.

In an image forming apparatus, a plurality of paper feed devices (paper feed units) may be attached. In an image forming apparatus, as an optional device, a paper feed device may be additionally provided. A plurality of paper feed devices are attached, and thus it is possible to increase the number of sheets stored. In general, the sheets of only one size can be set in one paper feed device. When only one paper feed device is present, and a sheet which is stored differs in size from a sheet which is desired to be printed, it is necessary to replace sheets. However, the sheets of different sizes are stored in a plurality of paper feed devices, and thus it is not necessary to replace sheets.

When a plurality of paper feed devices are attached, in terms of space saving, the paper feed devices may be stacked. For example, a plurality of paper feed devices are stacked in a lower portion of an image forming apparatus. In each of the paper feed devices, a paper feed roller (pickup roller) which feeds out the uppermost sheet loaded is provided. The sheet fed out by the paper feed roller is transported toward an image formation unit. A sheet which is supplied from the paper feed devices other than the lowermost paper feed device joins a transport path of the sheet which connects the lowermost paper feed device to the image formation unit.

In an image forming apparatus, a plurality of paper feed rollers may be rotated with one motor. In other words, when the motor is rotated, all the paper feed rollers are rotated. In such an image forming apparatus, in only a paper feed device which performs paper feeding, a placement plate (plate on which sheets are set) is raised. Then, the paper feed roller is brought into contact with the uppermost sheet. In this way, paper feeding is performed only by the selected paper feed device.

On the other hand, a user may overload a paper feed device with sheets. When sheets are set so as to exceed a specified number, the uppermost sheet may be brought into contact with the paper feed roller without the placement plate being raised. Disadvantageously, in the image forming apparatus in which all the paper feed rollers are rotated when the motor is rotated, not only the paper feed device which performs paper feeding but also an overload paper feed device performs paper feeding.

When a plurality of paper feed devices individually perform paper feeding, the sheets which are fed from the paper feed devices collide with each other (overlap each other). Thus, a jam may occur. Printing may be performed on the sheet of an unintended size. Hence, in the image forming apparatus in which all the paper feed rollers are rotated when the paper feed motor is rotated, it is necessary to determine which one of the paper feed devices encounters overload on sheets so as to prevent the occurrence of such a problem. However, a special sensor for detecting an overload state before the start of paper feeding is provided, and thus the manufacturing cost of the image forming apparatus and the paper feed devices is increased.

The known technology described above is not a technology which is intended for a plurality of paper feed devices. The known technology is also not a technology on the image forming apparatus in which all the paper feed rollers are simultaneously rotated when one paper feed motor is rotated. Hence, even with the known technology, it is impossible to solve the problem described above. In the known technology, an upper limit detection mechanism portion which detects that a tray (transfer member loading portion) on which sheets are placed is raised to the upper limit position is used as the overload determination means. Hence, since in the known technology, the upper limit detection mechanism portion does not detect that the paper feed roller reaches the upper limit, when sheets are excessively loaded such that the sheets are brought into contact with the paper feed roller, it is impossible to detect the excessive loading of the sheets.

SUMMARY

An image forming apparatus according to one aspect of the present disclosure includes a paper feed device, a print unit, a sheet sensor, an upper limit sensor, a control unit. The paper feed device includes: a cassette that has a placement plate on which a sheet is set and that can be opened by being removed; a paper feed roller that feeds out the sheet; and a raising/lowering mechanism that raises and lowers the placement plate. The print unit transports the sheet supplied and performs printing on the transported sheet. The sheet sensor detects an arrival and a passage of the sheet and which is provided in a transfer path of the sheet. The control unit recognizes, based on an output of the sheet sensor, that the sheet supplied from the paper feed device reaches an installation position of the sheet sensor. The control unit detects, based on an output of the upper limit sensor, that the paper feed roller reaches a predetermined upper limit position or that the raising/lowering mechanism raises the placement plate such that the sheet reaches a feed position. The control unit uses the sheet sensor and the upper limit sensor so as to detect that the paper feed device encounters overload.

Further features and advantages of the present disclosure will become apparent from the description of embodiments given below.

BRIEF DESCRIPTION OF THE DRAWINGS

FIG. 7 is a diagram showing an example of a reference time, a determination time and a margin in the embodiment.

DETAILED DESCRIPTION

In the present disclosure, in view of the problem in the conventional technology described above, in an image forming apparatus in which all paper feed rollers are simultaneously rotated, whether or not an overload paper feed device is present is accurately determined without its manufacturing cost being increased.

An embodiment of the present disclosure will be described below with reference to FIGS. 1 to 14. In the following discussion, a description will be given using an example of an image forming apparatus which includes a plurality of paper feed devices 1 that are stacked. As the image forming apparatus, a printer 100 is used as an example, and the description will be given. Individual elements such as configurations and arrangements described in the embodiment do not limit the scope of the disclosure, and are simply examples of the description. In the following description, the maximum value (maximum width of a sheet bundle) of the number of sheets which can be loaded on a placement plate 73 is a specified number. The specified number is determined as the optimum number for each type of paper feed devices 1.

(Outline of Image Forming Apparatus)

Figure 1:
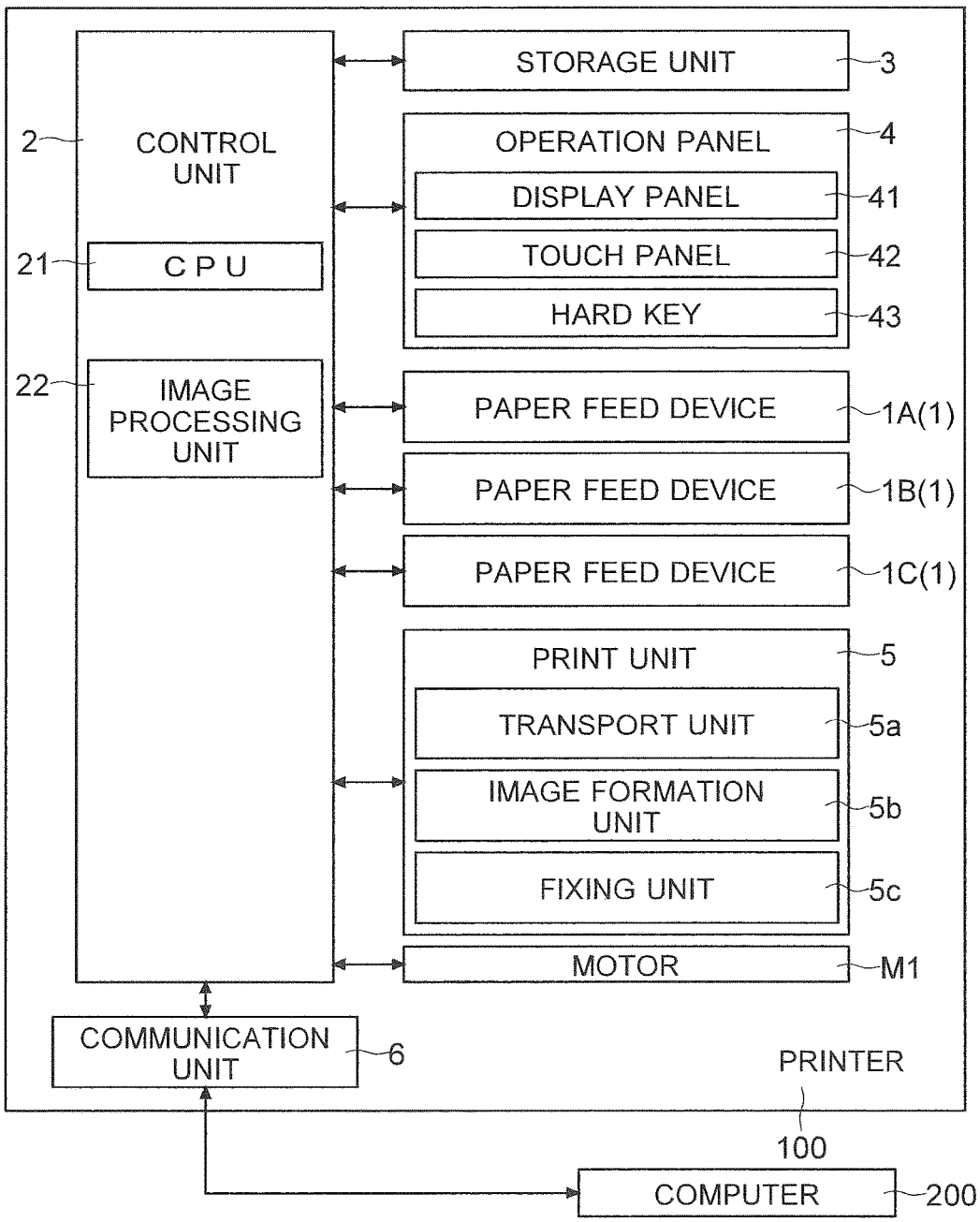
FIG. 1 is a diagram showing an example of a printer according to an embodiment.

The printer 100 according to the embodiment will first be described with reference to FIG. 1. FIG. 1 is a diagram showing an example of the printer 100 according to the embodiment.

The printer 100 includes a control unit 2 and a storage unit 3. The control unit 2 supervises the operation of the entire apparatus. The control unit 2 controls the individual portions of the printer 100. The control unit 2 also controls the operation of the paper feed devices 1. The control unit 2 includes a CPU 21 and an image processing unit 22. The CPU 21 performs computations and control. The image processing unit 22 performs image processing necessary for printing on image data. The storage unit 3 includes storage devices such as a ROM, a RAM and a HDD. The storage unit 3 stores programs for control and data.

The control unit 2 is connected to an operation panel 4 such that the control unit 2 can communicate with the operation panel 4. The operation panel 4 includes a display panel 41 (which corresponds to a notification unit), a touch panel 42 and hard keys 43. Examples of the hard key 43 include a start key. The control unit 2 controls the display of the display panel 41. The control unit 2 displays, on the display panel 41, a setting screen, the state of the printer 100 and information such as a message. The control unit 2 displays operation images on the display panel 41. The operation images are, for example, a soft key and a button. The control unit 2 recognizes, based on an output of the touch panel 42, the operation image which is operated. The control unit 2 recognizes the hard key 43 which is operated. The control unit 2 makes the display panel 41 switch to a screen corresponding to the operation image or the hard key 43 which is operated. The control unit 2 controls the printer 100 such that the printer 100 is operated according to a setting on the operation panel 4 made by a user.

The printer 100 includes a plurality of paper feed devices 1 (1A, 1B and 1C). When a print job is performed, the control unit 2 controls the operation of the paper feed devices 1. The control unit 2 selects one paper feed device 1 among from the paper feed devices 1. The control unit 2 makes the selected paper feed device 1 supply sheets.

The printer 100 includes a print unit 5 which performs printing based on the sheet fed from the paper feed device 1. The print unit 5 includes a transport unit 5*a*, an image formation unit 5*b* and a fixing unit 5*c*. The control unit 2 controls the operations of the transport unit 5*a*, the image formation unit 5*b* and the fixing unit 5*c*. Specifically, the control unit 2 controls printing-related processing such as the transport of the sheet and the formation, the transfer and the fixing of a toner image. The transport unit 5*a* includes a registration roller pair 52 and an ejection roller pair 53. The control unit 2 makes the transport unit 5*a* transport the sheet supplied from the paper feed device 1. The control unit 2 makes the transport unit 5*a* transport the sheet through the image formation unit 5*b* and the fixing unit 5*c* to an ejection tray 51 (see FIG. 2). The control unit 2 ejects the printed sheet to the ejection tray 51 (the outside of the apparatus). The image formation unit 5*b* includes a photosensitive drum 54, a transfer roller 55, a charging device 56, an exposure device 57 and a development device 58 (see FIG. 2). The control unit 2 forms, on the image formation unit 5*b*, a toner image (image) to be placed on the transported sheet. The control unit 2 transfers the toner image to the sheet. The fixing unit 5*c* includes a heating roller 59 and a pressure roller 510. The control unit 2 fixes the toner image transferred to the sheet in the fixing unit 5*c*.

The printer 100 includes a communication unit 6 (which corresponds to the notification unit). The communication unit 6 is an interface for communication with a computer 200. The computer 200 is, for example, a PC or a server. The communication unit 6 receives print data from the computer 200. The print data includes data which indicates the details of printing. The data indicating the details of printing is image data or data which is described with a page description language. The print data also includes data which indicates the details of a setting for printing. The control unit 2 makes the print unit 5 perform printing based on the print data.

(Paper Feed Devices 1)

Figure 2:
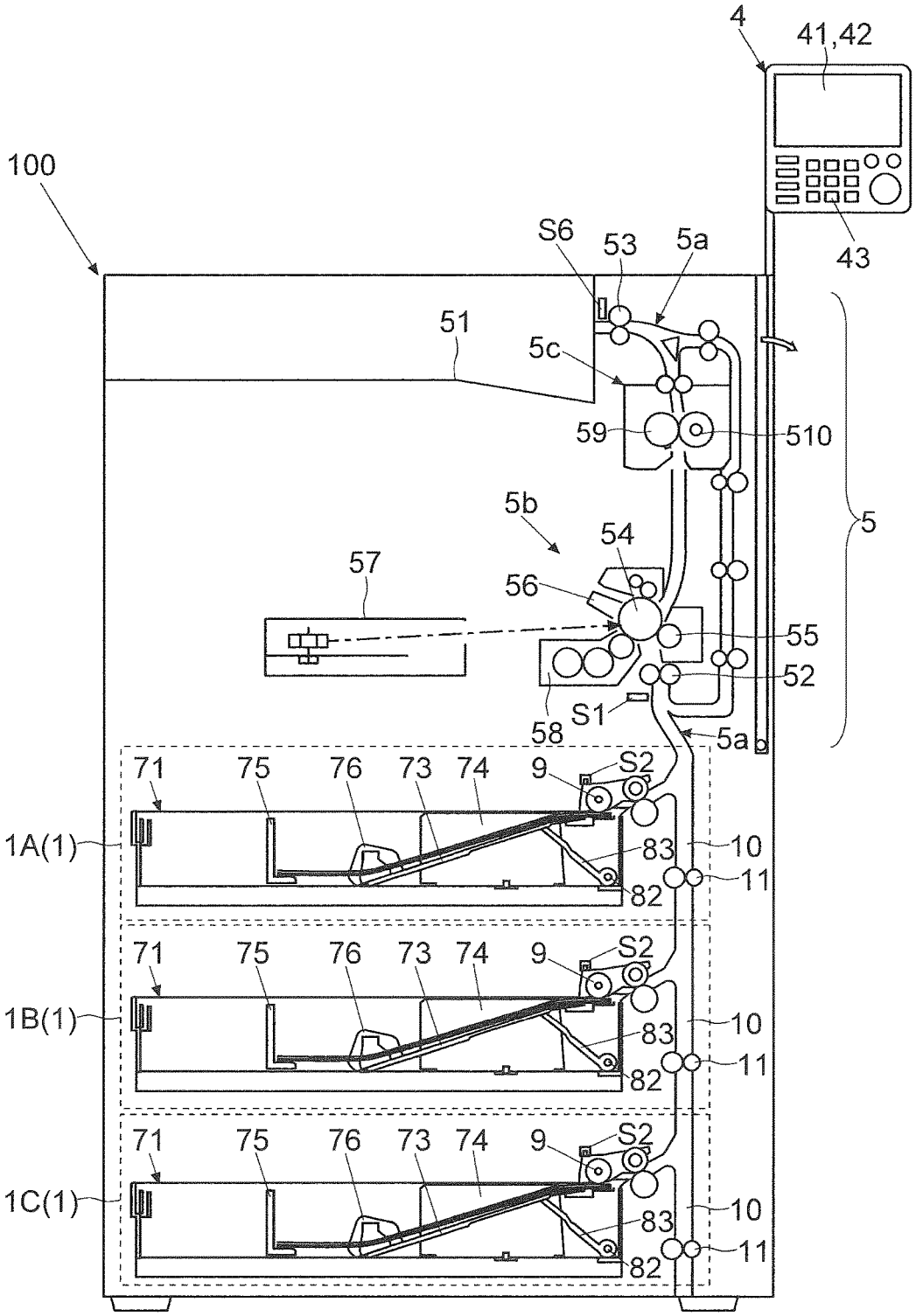
FIG. 2 is a diagram showing an example of the printer according to the embodiment.
Figure 3:
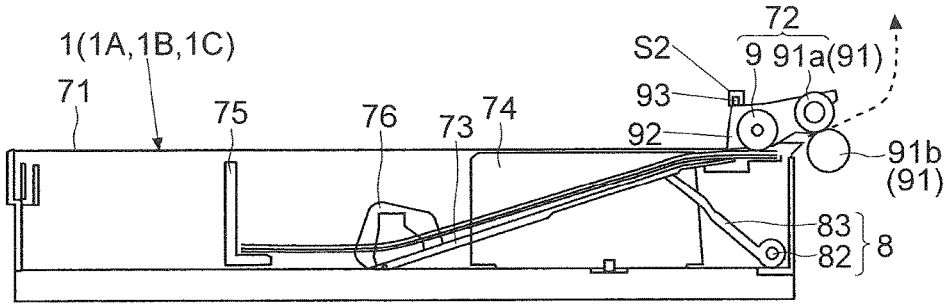
FIG. 3 is a diagram showing an example of a paper feed device according to the embodiment.
Figure 4:
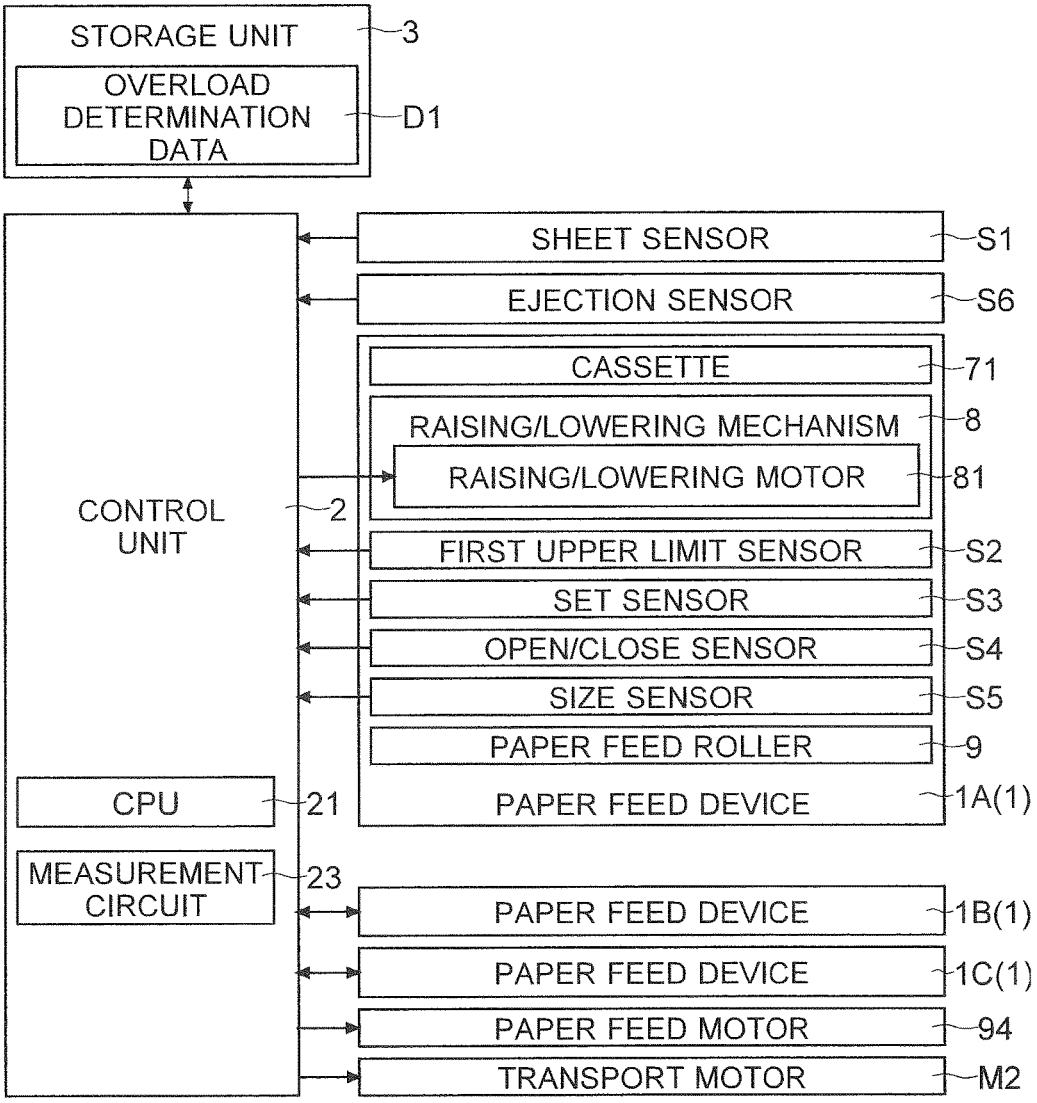
FIG. 4 is a diagram showing an example of the paper feed devices according to the embodiment.
Figure 5:
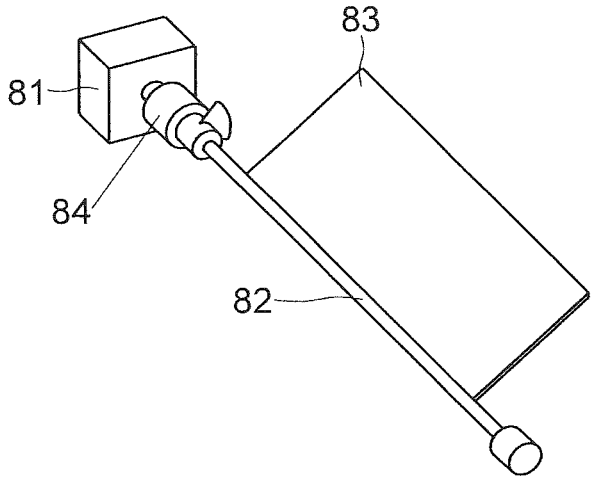
FIG. 5 is a diagram showing an example of a raising/lowering mechanism according to the embodiment.

The paper feed devices 1 according to the embodiment will then be described with reference to FIGS. 2 to 5. FIG. 2 is a diagram showing an example of the printer 100 according to the embodiment. FIGS. 3 and 4 are diagrams showing an example of the paper feed devices 1 according to the embodiment. FIG. 5 is a diagram showing an example of a raising/lowering mechanism 8 according to the embodiment.

The paper feed devices 1 store sheets. When a print job is performed, the paper feed devices 1 feed out the sheets one by one. As shown in FIG. 2, a plurality of paper feed devices 1 are stacked in an up/down direction. In the present discussion, an example where three paper feed devices 1 are stacked will be described. The number of devices stacked may be two or four or more. The number of devices stacked is not limited to three. Each of the paper feed devices 1 has the same configuration. In the following description, a paper feed device 1A is the uppermost paper feed device 1. A paper feed device 1B is the middle paper feed device 1. A paper feed device 1C is the lowermost paper feed device 1.

As shown in FIG. 2, a paper feed transport path 10 which is extended in a vertical direction is provided on the right side of each of the paper feed devices 1. The lower end of the paper feed transport path 10 in the upper paper feed device 1 is connected to the upper end of the paper feed transport path 10 in the lower paper feed device 1. The upper end of the paper feed transport path 10 in the uppermost paper feed device 1A is connected to the transport path which is connected to the registration roller pair 52. The registration roller pair 52 is provided in front of the image formation unit 5*b*. In the paper feed transport path 10 of each of the paper feed devices 1, a transport roller pair 11 which transports the sheet upward is provided. The sheet supplied from each of the paper feed devices 1 is passed through the coupled paper feed transport paths 10. The sheet is transported toward the image formation unit 5*b* (the registration roller pair 52). In other words, the sheet supplied from each of the paper feed devices 1 joins the paper feed transport paths 10 which connect the lowermost paper feed device 10 and the image formation unit 5*b* (the registration roller pair 52) together.

As shown in FIG. 2, a sheet sensor S1 is provided in the transport path of the sheet. The sheet sensor S1 detects the arrival and passage of the sheet. Specifically, the sheet sensor S1 is provided on the downstream side in a sheet transport direction with respect to the uppermost paper feed device 1A but on the upstream side of the registration roller pair 52. The sheet sensor S1 is a sensor which changes the level of an output signal depending on whether or not the sheet is present in an installation position. The sheet sensor S1 is, for example, an optical sensor. The output signal of the sheet sensor S1 is input to the control unit 2. Based on the output signal of the sheet sensor S1, the control unit 2 recognizes the arrival or passage of the sheet at or through the installation position (registration roller pair 52) of the sheet sensor S1.

The control unit 2 controls a motor M1 which is provided in the main body of the printer 100. The control unit 2 also controls an electromagnetic clutch (not shown) which is provided in the registration roller pair 52. Then, the control unit 2 controls the rotation of the registration roller pair 52. The control unit 2 does not rotate the registration roller pair 52 at the time of the arrival of the sheet. The tip end of the sheet hits the nip of the registration roller pair 52. Thus, the sheet is bent. The tip end of the sheet is put along the nip of the registration roller pair 52 due to the elasticity of the sheet. In this way, the skew of the sheet is corrected. After the sheet is bent, the control unit 2 rotates the registration roller pair 52 such that the toner image is transferred to the sheet without being displaced When the supplied sheet is transported to the ejection tray 51, the control unit 2 rotates the motor M1 (see FIG. 1). The control unit 2 rotates rotation members for transport of the sheet which are provided within the print unit 5. Specifically, the control unit 2 rotates the registration roller pair 52, the rotation member of the image formation unit 5*b* (the photosensitive drum 54 and the transfer roller 55), the rotation member of the fixing unit 5*c* (the heating roller 59 and the pressure roller 510) and the ejection roller pair 53.

The paper feed devices 1 will be described with reference to FIG. 3. The paper feed devices 1A, 1B and 10 have the same configuration. The paper feed device 1 shown in FIG. 3 can be the paper feed device 1A, the paper feed device 1B or the paper feed device 1C. Members included in the paper feed devices 1 are identified with the same symbols.

The paper feed device 1 includes a cassette 71 and a paper feed mechanism 72. The cassette 71 can be removed (opened) from the printer 100. The cassette 71 is removed, and it is possible to supply sheets or change sheets to be set. After the operation, the cassette 71 is pushed back (closed) by the user.

The cassette 71 includes the placement plate 73, a first cursor pair 74 (in FIG. 3, only one can be viewed) and a second cursor 75. Sheets (sheet bundle) are set on the upper surface of the placement plate 73. The end portion of the placement plate 73 on the upstream side (in FIG. 3, the left-side end portion) is supported by a support portion 76 such that the end portion can be turned. The end portion of the placement plate 73 on the downstream side (in FIG. 3, the right-side end portion) is a free end. The end portion on the downstream side is moved in the up/down direction.

The raising/lowering mechanism 8 is provided below the end portion of the placement plate 73 on the downstream side. The raising/lowering mechanism 8 raises and lowers the placement plate 73. The raising/lowering mechanism 8 includes a raising/lowering motor 81 (see FIG. 4), a drive shaft 82 and an action plate 83. The plate-shaped action plate 83 is attached to the drive shaft 82. The drive shaft 82 is rotated by receiving the drive of the raising/lowering motor 81.

The details of the raising/lowering mechanism 8 will be described with reference to FIG. 5. The raising/lowering motor 81 of the raising/lowering mechanism 8 is provided outside the cassette 71. The drive shaft 82 is extended in a direction perpendicular to the sheet transport direction. The drive shaft 82 is coupled through a joint portion 84 to the raising/lowering motor 81. The control unit 2 drives the raising/lowering motor 81. The drive shaft 82 and the action plate 83 attached to the drive shaft 82 are rotated.

When the cassette 71 is removed (opened), the joint portion 84 is separated. The coupling of the raising/lowering motor 81 and the drive shaft 82 is disengaged. When the coupling is disengaged, the placement plate 73 is lowered by the action of gravity so as to fall down (so as to be placed horizontally). The placement plate 73 is finally lowered to a lower limit position. In other words, when the cassette 71 is removed, the raising/lowering mechanism 8 lowers the placement plate 73 and the action plate 83 to the lower limit position. When the cassette 71 is pushed in and the joint portion 84 is fitted together, the raising/lowering motor 81 and the drive shaft 82 are coupled.

The control unit 2 raises the placement plate 73 in the paper feed device 1 (paper feed source device) which is used for the print job. The raising/lowering motor 81 is provided in each of the paper feed devices 1. When paper feeding is started, the control unit 2 controls the raising/lowering motor 81 of the paper feed source device. The control unit 2 raises the placement plate 73 (a paper feed roller 9) to the upper limit position. The control unit 2 keeps, in the lower limit position (the state where they fall down), the placement plates 73 and the action plates 83 in the paper feed devices 1 which are not used for the print job.

When the placement plate 73 is raised, the control unit 2 rotates the raising/lowering motor 81 forward. The drive shaft 82 is also rotated. In this way, the action plate 83 is turned in a direction in which the end portion of the placement plate 73 on the downstream side is pushed up. The placement plate 73 is pushed up (raised) by the action plate 83 which is turned.

When the printing is completed, the control unit 2 lowers the placement plate 73 which has been raised. When the placement plate 73 is lowered, the control unit 2 rotates the raising/lowering motor 81 backward. The drive shaft 82 is also rotated. In this way, the end portion of the action plate 83 is turned downward. The end portion of the placement plate 73 on the downstream side is lowered accordingly. The control unit 2 rotates the drive shaft 82 (the action plate 83) such that the placement plate 73 falls down (is placed horizontally). Thereafter, the control unit 2 stops the raising/lowering motor 81.

The cursors of the first cursor pair 74 can be made to slide in the direction perpendicular to the transport direction. The cursors are moved in a coordinated manner. The cursors are brought into contact with the sheets which are set. The cursors regulate the position of the sheets. The second cursor 75 can be made to slide along the transport direction. The second cursor 75 is brought into contact with the sheets which are set. The second cursor 75 regulates the position of the back ends of the sheets.

The paper feed mechanism 72 includes the paper feed roller 9 and a separating roller pair 91. The paper feed roller 9 is provided above the end portion of the placement plate 73 on the downstream side. The paper feed roller 9 feeds out the sheet toward the image formation unit 5*b* (the registration roller pair 52). The separating roller pair 91 is provided on the downstream side in the transport direction with respect to the paper feed roller 9. The roller (feed roller 91*a*) on the upper side of the separating roller pair 91 is rotated in such a direction as to feed the sheet in a forward direction. The separating roller pair 91 prevents stacked sheets from being fed.

The feed roller 91*a* is a drive roller. The feed roller 91*a* is coupled through a rotation shaft to a drive source (paper feed motor 94). The feed roller 91*a* is rotated while being in contact with the upper surface of the sheet which is fed by the paper feed roller 9. The sheet is fed. A predetermined rotation load is provided to the retard roller 91*b* (roller on the lower side). For example, the load is provided by a torque limiter. The retard roller 91*b* is a driven roller. The retard roller 91*b* is pressed onto the feed roller 91*a*. The retard roller 91*b* is brought into contact with the lower surface of the sheet which is fed by the paper feed roller 9. When stacked sheets are fed, the retard roller 91*b* stops the rotation by the rotation load. The retard roller 91*b* separates other sheets from the sheet in contact with the feed roller 91*a* by making the other sheets slide. The retard roller 91*b* may separate other sheets from the sheet by being rotated backward.

The paper feed roller 9 can be swung in the up/down direction. The rotation shaft of the paper feed roller 9 is supported by a support shaft member 92. The support shaft member 92 is placed over the rotation shaft of the upper roller in the separating roller pair 91. The support shaft member 92 is swung in the up/down direction according to the vertical movement of the paper feed roller 9. As shown in FIGS. 3 and 4, in the paper feed device 1, a first upper limit sensor S2 is provided. When the placement plate 73 is raised, the paper feed roller 9 is lifted up by the placement plate 73 or the sheets set on the placement plate 73. The first upper limit sensor S2 is a sensor for detecting that the paper feed roller 9 reaches the predetermined upper limit position.

As the end portion of the placement plate 73 on the downstream side is raised, the paper feed roller 9 and the uppermost sheet are brought into contact with each other. As the placement plate 73 is further raised, the paper feed roller 9 is also raised. The first upper limit sensor S2 detects the arrival of the paper feed roller 9 at the upper limit position. After the arrival of the paper feed roller 9 and the placement plate 73 at the upper limit position, the supply of the sheet is performed. The height of the placement plate 73 (the raising distance from the lower limit position) differs depending on the thickness of the sheet bundle which is currently set.

The first upper limit sensor S2 is, for example, a transmission-type optical sensor. In the first upper limit sensor S2, the output level (high level or low level) of a signal is changed depending on whether or not the paper feed roller 9 is in the upper limit position. When the paper feed roller 9 reaches the upper limit position, a protrusion 93 which is provided on the paper feed roller 9 or the support shaft member 92 interrupts an optical path between the light emission portion and the light reception portion of the first upper limit sensor S2 (optical sensor).

Based on the output of the first upper limit sensor S2, the control unit 2 recognizes the arrival of the paper feed roller 9 at the upper limit. When the placement plate 73 is raised, the control unit 2 rotates the raising/lowering motor 81 forward. When the control unit 2 detects that the paper feed roller 9 is lifted up to the upper limit position, the control unit 2 stops the raising/lowering motor 81. When the printing is continuously performed, as the supply of the sheet is repeated, the position of the paper feed roller 9 is lowered. When the control unit 2 recognizes, based on the output of the first upper limit sensor S2, that the paper feed roller 9 is lowered from the upper limit position, the control unit 2 temporarily rotates the raising/lowering motor 81. The control unit 2 lifts up again the paper feed roller 9 which is slightly lowered by the consumption of sheets to the upper limit position.

When the sheet is supplied, the control unit 2 rotates the paper feed motor 94. As shown in FIG. 4, in the printer 100, only one paper feed motor 94 is provided. The drive of the paper feed motor 94 is transmitted by a gear group (not shown) to the paper feed roller 9 and the separating roller pair 91 in each of the paper feed devices 1. In other words, the paper feed motor 94 rotates all the paper feed rollers 9. The supplied sheet is fed downstream by the paper feed roller 9, the separating roller pair 91 and the transport roller pair 11. The transport roller pairs 11 are rotated by receiving the drive of a transport motor M2 which is provided separately of the paper feed roller 9.

In the paper feed device 1, a set sensor S3 is provided. The set sensor S3 detects whether or not the sheet set is present (whether or not the sheet is set). The set sensor S3 is, for example, an optical sensor. The output level (high or low) of the signal of the set sensor S3 is changed depending on whether or not the sheet is present. Based on the output of the set sensor S3, the control unit 2 can detect whether or not the sheet is set in the cassette 71. When the sheet is not present, the control unit 2 produces a display on the display panel 41 indicating that sheets run out.

An open/close sensor S4 is a sensor for detecting the opening and closing of the cassette 71. The open/close sensor S4 is, for example, an interlock switch. The output level (high or low) of the signal of the open/close sensor S4 is changed depending on whether the cassette 71 is removed or pushed back. Based on the output of the open/close sensor S4, the control unit 2 can detect the state of the opening and closing of the cassette 71.

When sheets are supplied to the cassette 71 in each of the paper feed devices 1, the cassette 71 is removed (opened). A mark indicating the upper limit of the height of the sheet bundle set on the placement plate 73 is provided within the cassette 71. The mark is, for example, a sticky label which is adhered within the cassette 71 or a groove which is engraved in a resin material. The upper limit of the height of the sheet bundle (the specified number) is previously determined. The upper limit is set such that when the placement plate 73 is not raised in a state where the cassette 71 is closed, the paper feed roller 9 and the uppermost sheet are prevented from being brought into contact with each other.

Sheets may be excessively set in the cassette 71 (on the placement plate 73) so as to exceed the specified number. For example, the user may supply sheets in the cassette 71 in a state where sheets are left so that sheets are prevented from running out in the middle. Here, a new sheet bundle may be stacked on the sheets left within the cassette 71. Consequently, the sheets may be excessively set in the cassette 71.

In the printer 100, when the paper feed motor 94 is rotated, all the paper feed rollers 9 are rotated. Hence, sheets may be fed out from the two paper feed devices 1 that are the paper feed device 1 used for the print job and the overload paper feed device 1. Thus, the printing may be performed on the sheet of an unintended size. A paper jam (jam) may occur. Hence, in the printer 100, whether or not an overload paper feed device 1 is present is determined. The determination as to whether or not an overload paper feed device 1 is present and processing when an overload paper feed device 1 is present will be described below.

(Flow of Paper Feeding and Determination on Overload)

Figure 6:
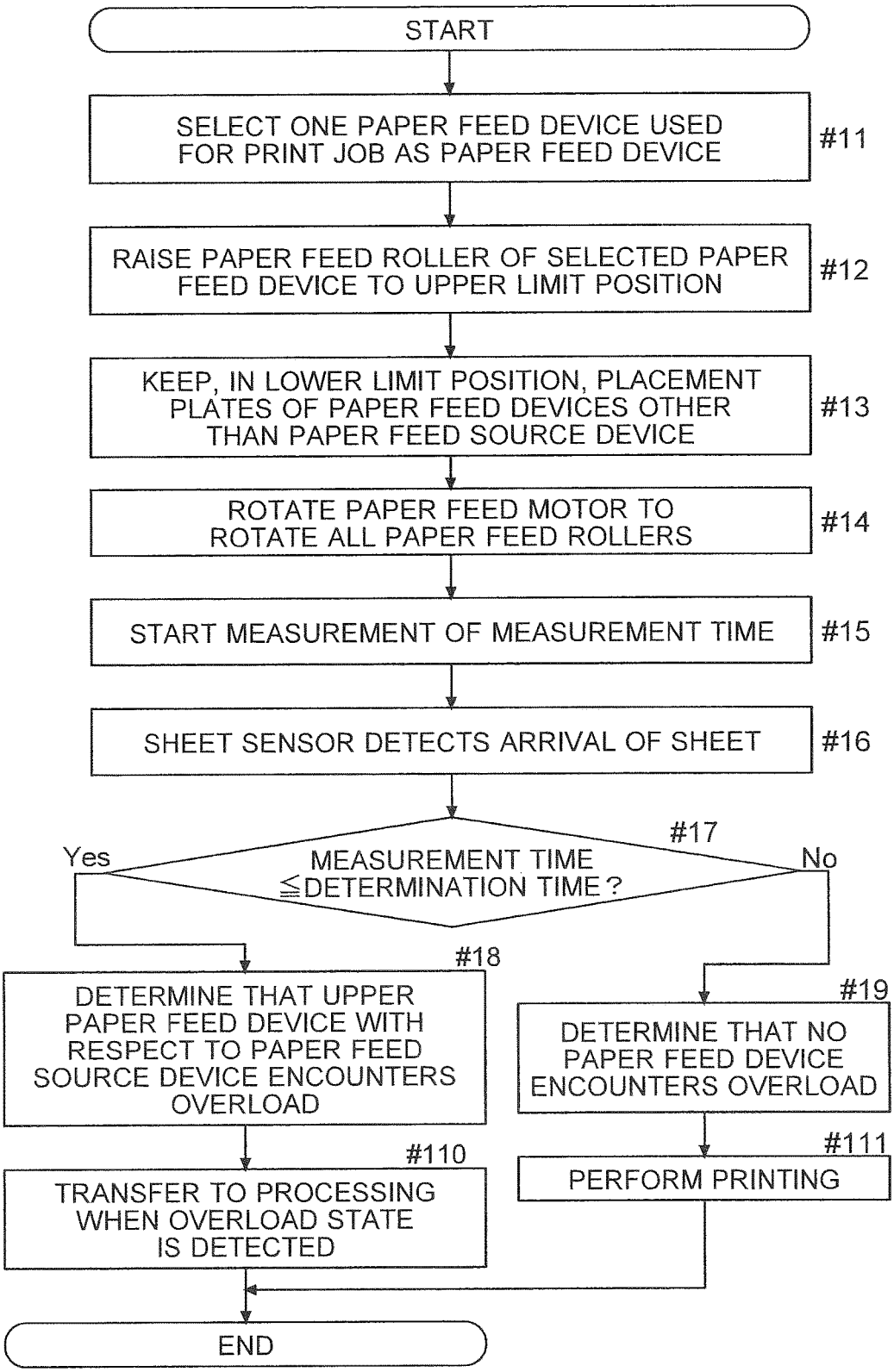
FIG. 6 is a flowchart showing an example of the flow of a determination on overload in the printer according to the embodiment.

The flow of paper feeding and a determination on overload in the printer 100 according to the embodiment will then be described with reference to FIGS. 6 and 7. FIG. 6 is a flowchart showing an example of the flow of a determination on overload in the printer 100 according to the embodiment. FIG. 7 is a diagram showing an example of a reference time, a determination time and a margin in the embodiment.

The flowchart of FIG. 6 is the time when the print data is received from the computer 200 and then printing is stated based on the print data. Based on the print data, the control unit 2 selects, from among a plurality of paper feed devices 1, one paper feed device 1 (paper feed source device) used for the print job (step #11). The paper feed device 1 used for printing can be specified by driver software in the computer 200. The control unit 2 selects, as the paper feed source device, the paper feed device 1 specified by the driver software.

When the paper feed device 1 is not specified, the control unit 2 selects, as the paper feed source device, the paper feed device 1 in which the sheets of a size specified by the print data are stored. The control unit 2 recognizes the sizes of the sheets which are stored in the paper feed devices 1. For example, the operation panel 4 receives a setting for the sizes of the sheets which are stored in the paper feed devices 1. The control unit 2 recognizes the set sizes as the sizes of the sheets which are stored in the paper feed devices 1. A size sensor S5 which detects the size of the sheets may be provided in each of the paper feed devices 1 (see FIG. 4). Based on the output of the size sensor S5, the control unit 2 may recognize the size of the sheets which are stored in each of the paper feed devices 1.

Then, the control unit 2 rotates the raising/lowering motor 81 of the selected paper feed device 1 forward so as to raise the paper feed roller 9 to the upper limit position (step #12). In other words, the control unit 2 makes the raising/lowering mechanism 8 of the paper feed source device raise the placement plate 73. Then, the control unit 2 brings the uppermost sheet placed on the placement plate 73 of the paper feed source device into contact with the paper feed roller 9 of the paper feed source device. On the other hand, the control unit 2 makes the raising/lowering mechanisms 8 of the paper feed devices 1 which are prevented from supplying the sheets (the paper feed devices 1 other than the paper feed source device) keep the placement plates 73 in the lower limit position (step #13).

After the completion of the raising of the placement plate 73, the control unit 2 rotates the paper feed motor 94 (the rotation of all the paper feed rollers 9, step #14). At the same time, the control unit 2 starts the measurement of a measurement time until the arrival of the sheet is detected by the sheet sensor S1 after the start of the rotation of the paper feed motor 94 (step #15). For example, the CPU 21 measures the measurement time. A measurement circuit 23 for measuring the measurement time may be provided in the control unit 2 (see FIG. 4). The sheet sensor S1 detects the arrival of the sheet (step #16).

The control unit 2 checks whether or not the obtained measurement time is equal to or less than a predetermined determination time (step #17). When the measurement time is equal to or less than the determination time (yes in step #17), the control unit 2 determines that the upper paper feed device 1 with respect to the paper feed source device encounters overload (step #18). On the other hand, when the measurement time exceeds the determination time (no in step #17), the control unit 2 determines that no paper feed device 1 encounters overload (step #19).

Here, the determination time will be described with reference to FIG. 7. The determination time is a time for determining whether or not an overload paper feed device 1 is present. The overload means that the number of sheets which are set exceeds the specified number. The determination time is previously determined and is stored in the storage unit 3 (see FIGS. 1 and 3).

The determination time is determined based on the reference time. The reference time is a time serving as the reference for the measurement time. Specifically, the time which is obtained by dividing a transport distance from the end portion of the set sheets on the downstream side to the sheet sensor S1 by a design sheet transport speed is set to the reference time. The determination time is the time which is obtained by subtracting a predetermined margin from the reference time. The starting point (position in which the sheet is set) of the transport distance is the position of the end portion of the uppermost sheet on the downstream side when the paper feed roller 9 is raised to the upper limit in a state where the sheets are ideally stored. The paper feed devices 1 differ from each other in the distance from the cassette to the sheet sensor S1. Hence, the reference time and the determination time are determined for each of the paper feed devices 1. In other words, the storage unit 3 stores a plurality of types of reference times and determination times. The differences between them are based on the differences between the transport distances to the sheet sensor S1. The margin corresponding to the transport distance from the position in which the sheet is set to the sheet sensor S1 is intended for removing the erroneous detection of overload.

FIG. 7 shows an example of overload determination data D1 which includes the determination time. In FIG. 7, the reference time for the uppermost paper feed device 1A is T1. The reference time for the middle paper feed device 1B is T2. The reference time for the lowermost paper feed device 1C is T3. Based on the distance to the sheet sensor S1, a relationship of T1<T2<T3 holds true. FIG. 7 shows an example where the margins for the middle paper feed device 1B and the lowermost paper feed device 1C are the same values. The individual paper feed devices 1 may differ from each other in the size of the margin.

For example, it is assumed that the paper feed source device is the middle paper feed device 1B and that the uppermost paper feed device 1A encounters overload on sheets. In this case, the sheet which is erroneously fed from the paper feed device 1A reaches the sheet sensor S1 earlier than the sheet (reference time T2) which is fed from the paper feed device 1B. When the upper paper feed device 1 with respect to the paper feed source device encounters overload, the measurement time is shorter than the corresponding reference time.

Hence, the margin for the paper feed device 1B may be determined such that the determination time for the paper feed device 1B is a time between the reference time T1 for the paper feed device 1A and the reference time T2 for the paper feed device 1B. The margin for the paper feed device 1C may be determined such that the determination time for the paper feed device 10 is a time between the reference time T2 for the paper feed device 1B and the reference time T3 for the paper feed device 1C. The paper feed device 1A is the uppermost paper feed device. Hence, the determination time corresponding to the uppermost paper feed device 1A is set to 0. The determination time is prevented from being equal to or less than the determination time. In this way, it is possible to prevent the upper paper feed device 1 with respect to the paper feed device 1A from being erroneously determined to encounter overload. Hence, the margin for the uppermost paper feed device 1A may be set to the reference time T1 for the uppermost paper feed device 1A.

When the overload paper feed device 1 is determined to be present (step #18), the control unit 2 transfers to processing at the time of the overload determination (step #110). Then, the present flow is completed (end). On the other hand, when no overload paper feed device 1 is determined to be present (step #19), the control unit 2 makes the print unit 5 perform the printing (step #111). Specifically, the control unit 2 makes the transport unit 5*a* (the registration roller pair 52 and the ejection roller pair 53 provided in the vicinity of a sheet ejection port) transport the sheet. The control unit 2 makes the image formation unit 5*b* perform the formation of the toner image and the transport of the sheet. The control unit 2 makes the fixing unit 5*c* perform the fixing of the toner image and the transport of the sheet. Then, the present flow is completed (end).

(Processing at the Time of Overload Determination)

Figure 8:
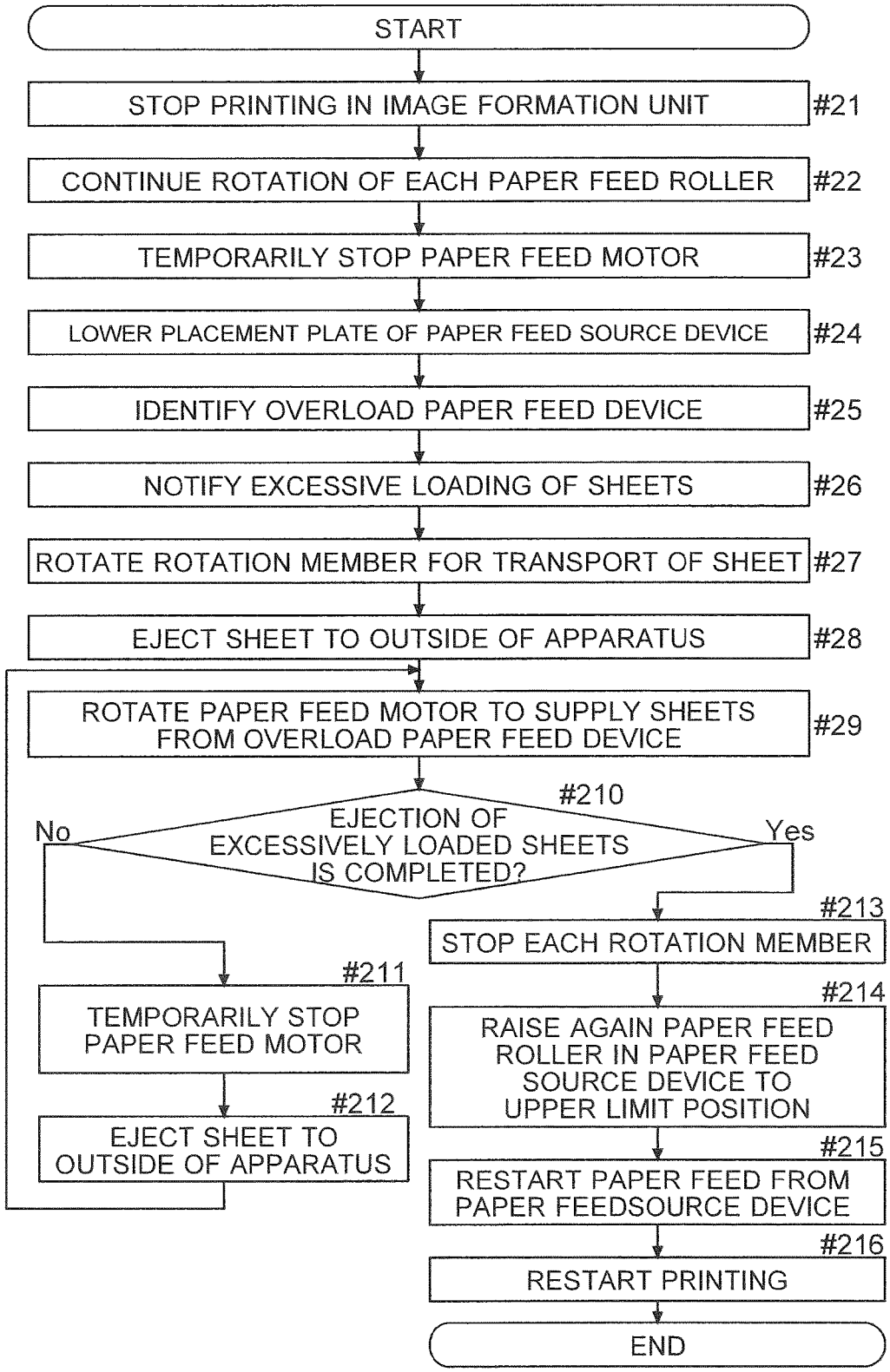
FIG. 8 is a flowchart showing an example of the flow of processing at the time of overload determination in the printer according to the embodiment.
Figure 9:
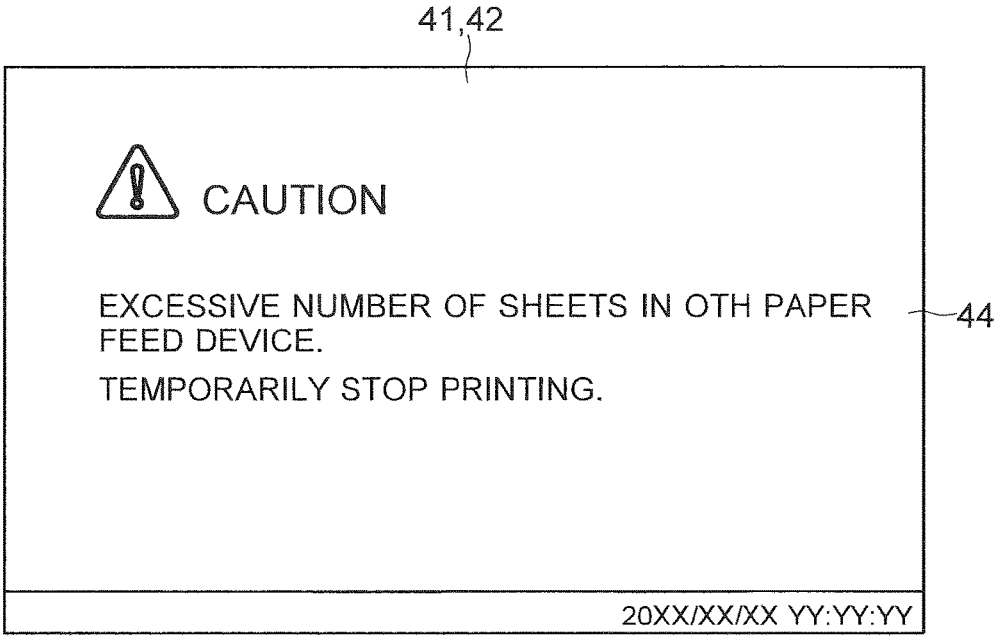
FIG. 9 is a diagram showing an example of an overload notification screen in the embodiment.

An example of the flow of the processing at the time of the overload determination in the printer 100 according to the embodiment will then be described with reference to FIGS. 8 and 9. FIG. 8 is a flowchart showing the example of the flow of the processing at the time of the overload determination in the printer 100 according to the embodiment. FIG. 9 is a diagram showing an example of an overload notification screen 44.

In order to prevent useless toner from being consumed, the control unit 2 makes the image formation unit 5*b* stop the printing (the formation of the toner image) (step #21). Then, the control unit 2 continues the rotation of the paper feed motor 94 (the paper feed rollers 9) for the reference time for the paper feed source device or for a time obtained by adding a predetermined additional time to the reference time (step #22). The control unit 2 has the sheets supplied from the paper feed source device and the overload paper feed device 1 ejected. Hence, the sheets supplied from the paper feed devices 1 reach the registration roller pair 52. Thereafter, the control unit 2 temporarily stops the paper feed motor 94 in order to form a space between the sheets (step #23).

The control unit 2 rotates the raising/lowering motor 81 of the paper feed source device backward such that the raising/lowering mechanism 8 of the paper feed source device lowers the placement plate 73 to the lower limit position (step #24). When the overload paper feed device 1 is determined to be present, the control unit 2 temporarily stops the feeding of the sheet from the paper feed source device. The control unit 2 temporarily stops the printing of the sheet supplied from the paper feed source device.

When the overload paper feed device 1 is determined to be present, the control unit 2 identifies the overload paper feed device 1 based on the measurement time obtained and the reference times for the paper feed devices 1 (step #25). For example, the control unit 2 compares one or a plurality of reference times corresponding to the upper paper feed device 1 with respect to the paper feed source device with the measurement time obtained. The control unit 2 determines that the paper feed device 1 corresponding to the reference time which is the closest to the measurement time is the overload paper feed device 1. For example, when the lowermost paper feed device 1C is selected as the paper feed source device, the control unit 2 determines a difference between the reference time corresponding to the uppermost paper feed device 1A and the measurement time. The control unit 2 also determines a difference between the reference time corresponding to the middle paper feed device 1B and the measurement time. The control unit 2 identifies the paper feed device 1 corresponding to the absolute value of one of the differences which is less than the absolute value of the other difference as the overload paper feed device 1. When only one upper paper feed device 1 is present (when the paper feed device 1B is selected as the paper feed source device), the control unit 2 identifies only the paper feed device 1A as the overload paper feed device 1.

The control unit 2 provides a notification that the identified paper feed device 1 encounters overload on sheets (step #26). In order to provide the notification, as shown in FIG. 9, the control unit 2 displays the overload notification screen 44 on the display panel 41. On the screen of the computer 200 which transmits the print data, the overload notification screen 44 may be displayed. In this case, the control unit 2 makes the communication unit 6 transmit the message of the overload notification screen 44 or an instruction to display the overload notification screen 44 to the computer 200 which transmits the print data. The computer 200 which receives the message or the instruction displays the overload notification screen 44 on its display.

The control unit 2 rotates the rotation members for the transport of the sheet (does not rotate the paper feed motor 94, step #27). For example, the control unit 2 rotates the transport roller pair 11 in the paper feed transport path 10. The control unit 2 also rotates the registration roller pair 52, the ejection roller pair 53, the rotation member of the image formation unit 5*b* and the rotation member of the fixing unit 5*c*. The control unit 2 rotates the rotation member of the print unit 5 related to the transport of the sheet. Consequently, the sheets which are supplied from the overload paper feed device 1 and the paper feed source device are ejected to the outside of the apparatus (step #28).

An ejection sensor S6 is provided in the vicinity of the ejection roller pair 53 (see FIGS. 2 and 4). The ejection sensor S6 detects the arrival and passage of the sheet. The ejection sensor S6 is, for example, an optical sensor. The level of the output signal of the ejection sensor S6 is changed depending on whether or not the sheet is present in the installation position. The output signal of the ejection sensor S6 is input to the control unit 2. The control unit 2 recognizes, based on the output signal of the ejection sensor S6, the arrival or passage of the sheet at or through the installation position (sheet ejection port) of the ejection sensor S6. When the ejection sensor S6 recognizes the passage of the sheet, the control unit 2 recognizes that the sheet is ejected to the ejection tray 51 (the outside of the apparatus).

The control unit 2 starts the rotation of the paper feed motor 94 such that the sheet is fed from the overload paper feed device 1 (step #29). Then, the control unit 2 checks, based on the output of the sheet sensor S1, whether or not the ejection of all the excessively loaded sheets is completed (step #210). Specifically, the control unit 2 starts (restarts) the rotation of the paper feed motor 94. Then, even when a predetermined overload ejection completion time has elapsed since the restart, and the sheet sensor S1 does not detect the arrival of the sheet, the control unit 2 determines that the ejection of the excessively loaded sheets is completed.

The supply of the sheets from the overload paper feed device 1 is continued without the placement plate 73 being raised. Consequently, the paper feed roller 9 in the overload paper feed device 1 and the sheet enter a state where they make slight contact with each other or a state where they do not make contact with each other. In other words, they enter a state where even when the paper feed roller 9 is rotated, the sheet is not fed. These states are said to be the state where the ejection of the excessively loaded sheets is completed. On the other hand, each time the sheet is supplied from the overload paper feed device 1, the position of the upper surface of the sheet bundle is lowered. There is a possibility that a slip is more likely to occur. Consequently, there is a possibility that the sheet is unlikely to be fed. For example, the overload ejection completion time can be set to the time which is about a few times (twice to three times) the reference time of the identified overload paper feed device 1.

When the ejection of the excessively loaded sheets is not completed (no in step #210), in order to form a space between the sheets, the control unit 2 temporarily stops the paper feed motor 94 (step #211). The control unit 2 temporarily stops the paper feed motor 94. For example, the control unit 2 stops the paper feed motor 94 in the middle of a state where the sheet sensor S1 detects the presence of the sheet and where the registration roller pair 52 transports the sheet. Then, the rotation of various types of rotation members is continued (the transport roller pair 11, the registration roller pair 52, the ejection roller pair 53, the rotation member of the image formation unit 5*b* and the rotation member of the fixing unit 5*c*). The sheet supplied from the overload paper feed device 1 is ejected to the outside of the apparatus (step #212). Then, the flow returns to step #29.

When the ejection of the excessively loaded sheets is completed (yes in step #210), the control unit 2 stops all the rotation members (step #213). Specifically, the control unit 2 stops the paper feed roller 9 (the paper feed motor 94). The control unit 2 also stops the transport roller pair 11. The control unit 2 also stops the registration roller pair 52 and the ejection roller pair 53 in the print unit 5, the rotation member of the image formation unit 5*b* and the rotation member of the fixing unit 5*c*.

In order to restart the printing, the control unit 2 rotates the raising/lowering motor 81 of the paper feed source device forward. The placement plate 73 of the paper feed source device is raised. The control unit 2 raises again the paper feed roller 9 of the paper feed source device to the upper limit position (step #214). The control unit 2 rotates the paper feed motor 94. The control unit 2 makes the paper feed source device restart the feeding of the sheet (step #215).

The control unit 2 makes the print unit 5 restart the printing (step #216). Specifically, the control unit 2 rotates the registration roller pair 52 and the ejection roller pair 53. The control unit 2 makes the image formation unit 5*b* perform the formation of the toner image and the rotation of the rotation member. The control unit 2 makes the fixing unit 5*c* perform the fixing processing and the rotation of the rotation member. In this way, after the automatic ejection of the excessively loaded sheets, the printing which is stopped by the overload paper feed device 1 is automatically restarted.

(Notification on Overload Related to Lowermost Paper Feed Device 1)

Figure 10:
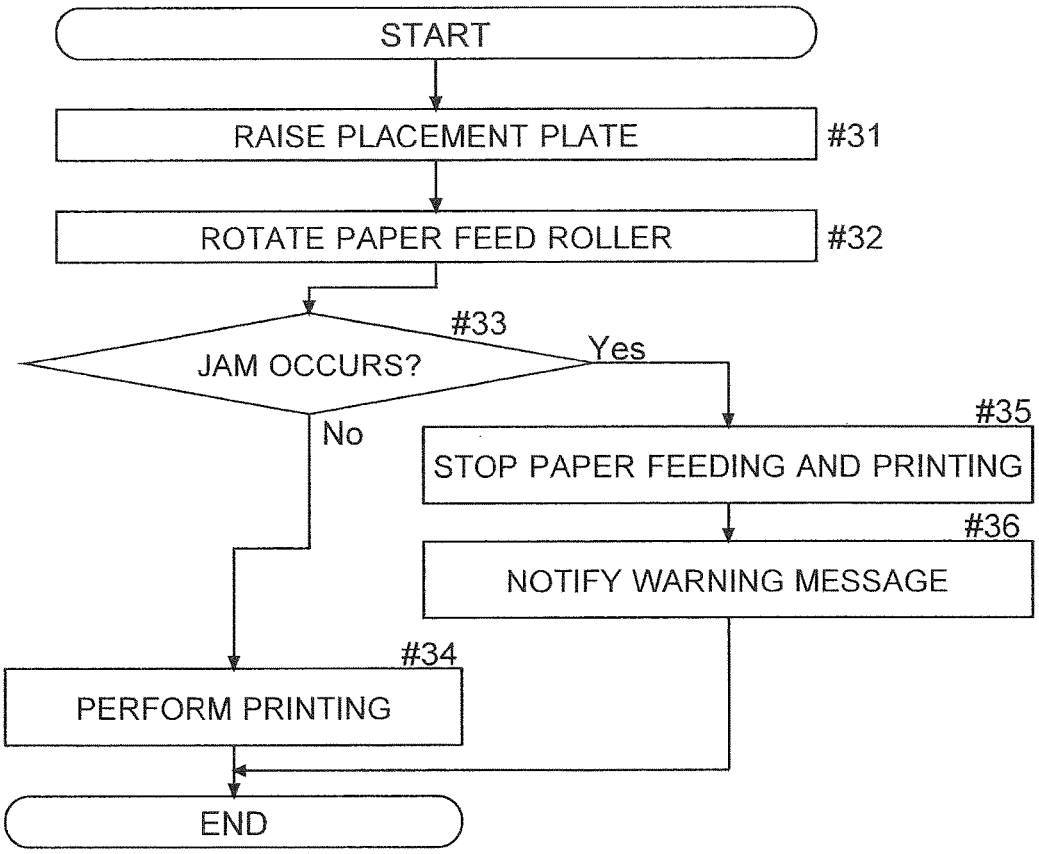
FIG. 10 is a flowchart showing an example of the flow of a notification on overload related to the lowermost paper feed device in an image forming apparatus according to the embodiment.
Figure 11:
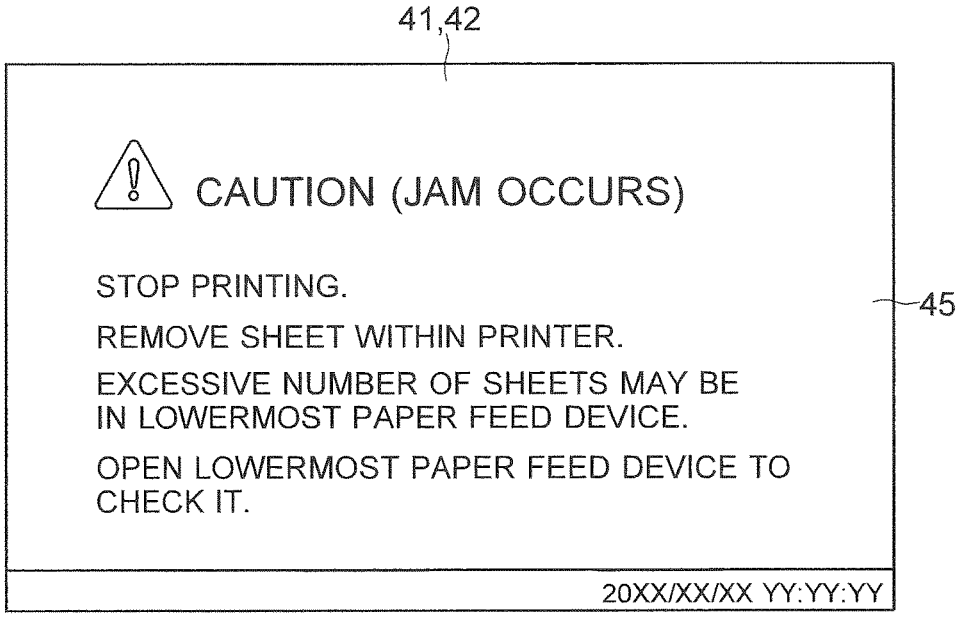
FIG. 11 is a diagram showing an example of an overload warning screen in the embodiment.

A notification on overload related to the lowermost paper feed device 1 in the image forming apparatus according to the embodiment will then be described with reference to FIGS. 10 and 11. FIG. 10 is a flowchart showing an example of the flow of the notification on overload related to the lowermost paper feed device 1 in the image forming apparatus according to the embodiment. FIG. 11 is a diagram showing an example of an overload warning screen 45 in the embodiment.

The control unit 2 can determine, based on the measurement time and the determination time, whether or not the upper paper feed devices 1 with respect to the paper feed source device include an overload paper feed device 1. For the lowermost paper feed device 10, whether or not the lowermost paper feed device 10 encounters overload is not determined in the flowchart of FIG. 8, and other processing is performed.

The processing on overload related to the lowermost paper feed device 10 will be described below with reference to FIGS. 10 and 11. It is assumed that each of the paper feed devices 1 includes the open/close sensor S4 which detects the opening and closing of the cassette 71. Based on the output of the open/close sensor S4 in the paper feed device 10, the control unit 2 recognizes that the opening or closing of the cassette 71 in the lowermost paper feed device 1 is performed.

The control unit 2 detects the occurrence of a jam. The control unit 2 detects the occurrence of a jam based on the output of the sheet sensor S1. For each sheet size, a jam detection time for the detection of the occurrence of a jam is previously determined. The jam detection times for the individual sheet sizes are stored in the storage unit 3. Even when after the jam detection time has elapsed since the start of the transport of the sheet in the registration roller pair 52, the passage of the sheet cannot be detected, the control unit 2 determines that a jam occurs.

For example, the time (ideal time) is determined which is obtained by dividing the length of the sheet in the transport direction by the design (specification) transport speed (circumferential velocity of the registration roller pair 52). The jam detection time can be determined by performing an addition or a subtraction on the ideal time. For example, the jam detection time may be set to the time which is obtained by subtracting, from the ideal time, the time obtained by dividing the distance from the sheet sensor S1 to the registration roller pair 52 by the design transport speed. A time with consideration given to a delay of the transport caused by a slip may be added to the jam detection time.

The start of the flowchart of FIG. 10 is the time when after the opening or closing of the lowermost paper feed device 10, the paper feed device 1 other than the paper feed device 10 is set to be the paper feed source device and when the printing is first started.

The control unit 2 first raises the placement plate 73 until the paper feed roller 9 of the paper feed source device reaches the upper limit position (rotates the raising/lowering motor 81 of the paper feed source device forward, step #31). The control unit 2 rotates the paper feed motor 94 so as to rotate the paper feed roller 9 (step #32).

The control unit 2 checks, based on the output of the sheet sensor S1, whether or not a jam occurs (step #33). In other words, the control unit 2 checks whether or not the passage of the sheet is detected within the jam detection time after the start of the rotation of the registration roller pair 52. When the occurrence of a jam is not detected (no in step #33), there is no particular problem. Hence, the control unit 2 makes the print unit 5 perform the printing (step #34). Then, the present flow is completed.

When a jam occurs (yes in step #33), the lowermost paper feed device 10 may encounter overload. In other words, the occurrence of a jam may be caused by the stacking of the sheet fed from the lowermost paper feed device 10 and the sheet fed from the paper feed source device. However, there is a slight possibility that stacked sheets in the paper feed source device are fed.

Hence, when a jam occurs (yes in step #33), the control unit 2 stops the feeding of the sheet and the printing (step #35). Specifically, the control unit 2 stops the paper feed motor 94. The control unit 2 stops the transport roller pair 11, the registration roller pair 52, the ejection roller pair 53, the rotation member of the image formation unit 5*b* and the rotation member of the fixing unit 5*c*. The state of the sheet jam is not degraded. The control unit 2 also makes the image formation unit 5*b* stop the formation of the toner image.

The control unit 2 makes the notification unit notify a warning message (step #36). The warning message indicates that the lowermost paper feed device 10 may encounter overload. FIG. 11 shows an example of the overload warning screen 45. The overload warning screen 45 includes the warning message. The control unit 2 may display the overload warning screen 45 on the display panel 41. The control unit 2 may display the overload warning screen 45 on the display of the computer 200. In this case, the control unit 2 makes the communication unit 6 transmit data for displaying the overload warning screen 45 to the computer 200 which is the sender of the print data. With these notifications, it is possible to prompt the user to check the overload paper feed device 1. Then, the present flow is completed (end). Thereafter, the user checks the lowermost paper feed device 1 and performs a jam processing operation.

(First Variation)

In the above discussion, the example is described where when the sheet reaches the sheet sensor S6 earlier, it is determined that the paper feed device encounters overload. The example is also described where the sheet is fed and ejected and thus the overload state is removed. In other words, the example is described where at the time of the printing, the placement plate 73 is raised and then whether or not the paper feed device encounters overload is determined. A first variation will then be described with reference to FIGS. 12 to 14.

In the variation, when the cassette 71 is closed (before the placement plate 73 is raised), the control unit 2 determines whether or not the paper feed device encounters overload.

Figure 12:
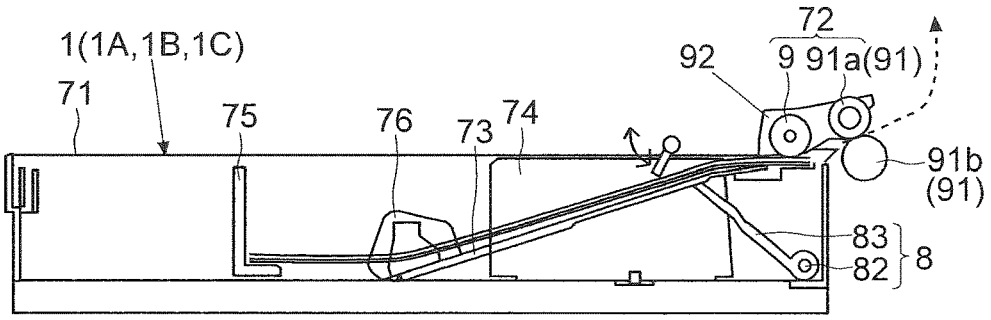

A difference in the configuration of the paper feed device 1 between the printer of the variation and the printer 100 described above and according to the embodiment will first be described with reference to FIG. 12. Specifically, the variation differs from the embodiment described above in the type of upper limit sensor. In the variation, instead of the first upper limit sensor S2, a second upper limit sensor S7 is provided. The variation is the same as the embodiment described above except the upper limit sensor which will be particularly described. Since the common portions can be shared, the description thereof will be omitted.

The second upper limit sensor S7 is provided on the side of the inner wall of the cassette 71. The second upper limit sensor S7 detects, by the raising of the placement plate 73 with the raising/lowering mechanism 8, that the sheet reaches a feed position. Here, the feed position refers to the position of the sheet when the paper feed roller 9 makes contact with the sheet so as to feed the sheet. The second upper limit sensor S7 includes, for example, an actuator. When the sheet reaches the feed position, the actuator is pushed up by the sheet. The actuator is pushed up, and thus the second upper limit sensor S7 is turned on. The output of the second upper limit sensor S7 is input to the control unit 2. The control unit 2 detects that the sheet reaches the feed position. When the arrival of the sheet at the feed position is detected by the second upper limit sensor S7, the control unit 2 controls the raising/lowering mechanism 8. Specifically, the control unit 2 stops the raising of the placement plate 73.

Figure 13:
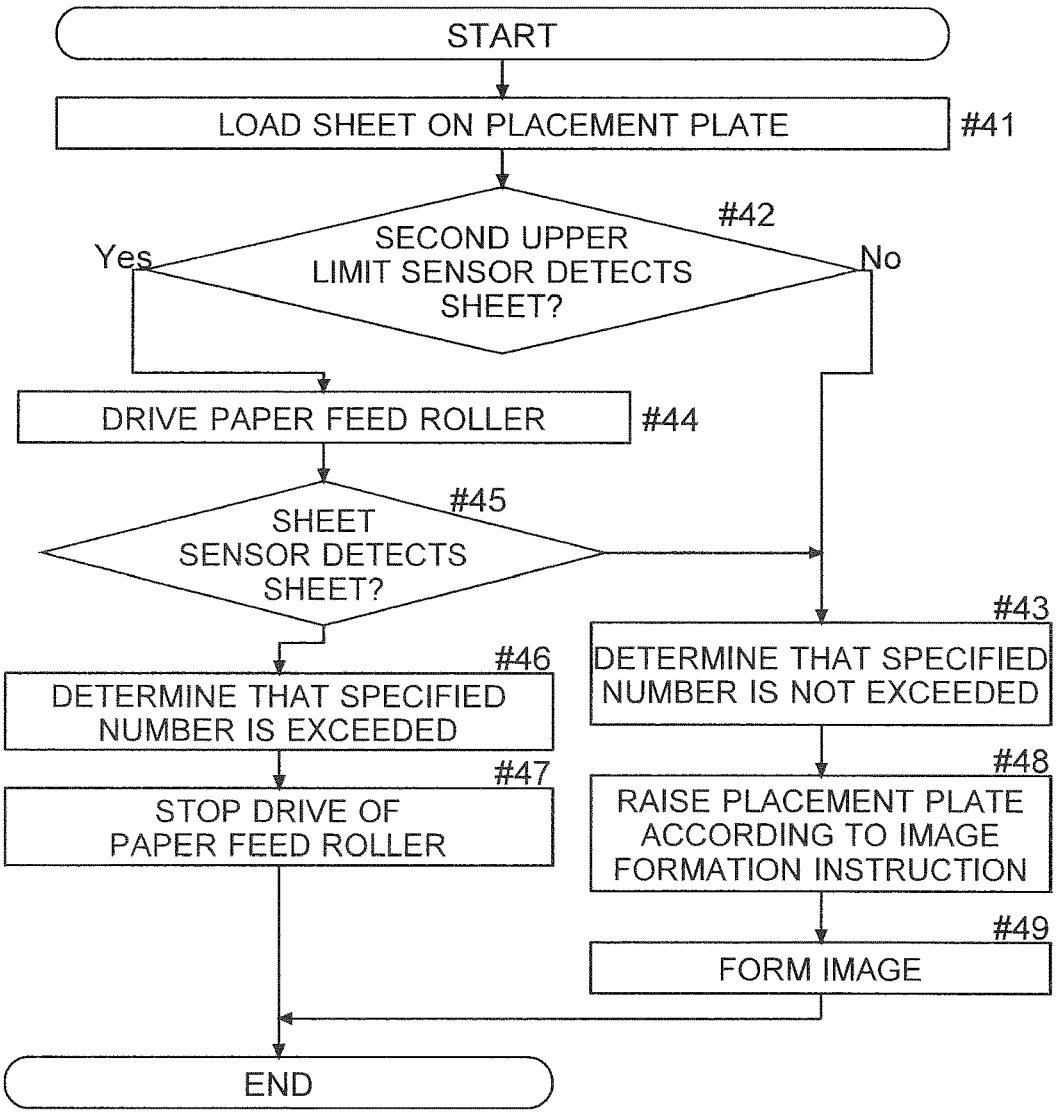

An example of the flow of a determination as to whether or not the specified number in the paper feed device 1 according to the first variation is exceeded will then be described with reference to FIGS. 12 and 13. FIG. 13 is a flowchart showing the example of the flow of a determination as to whether or not the specified number in the first variation is exceeded. The paper feed device 1 according to the first variation performs steps #41 to #49 so as to determine whether or not the number of sheets loaded exceeds the specified number. Specifically, the flow is as follows.

The cassette 71 is first opened when the sheets are supplied, and the sheets are set (loaded) on the placement plate 73 (step #41). The sheets are stored in the cassette 71. Then, the cassette 71 is fitted to the printer 100. When the cassette 71 is fitted to the printer 100, the control unit 2 checks, based on the output of the second upper limit sensor S7, whether or not the sheet reaches the feed position (step

#42). In other words, based on the output of the open/close sensor S4, when the cassette 71 is closed, the control unit 2 checks the output of the second upper limit sensor S7. Specifically, before the raising of the placement plate 73 with the raising/lowering mechanism 8 is started, the control unit 2 checks whether or not the second upper limit sensor S7 detects the sheet (step #42).

Here, the feed position refers to the position of the sheet when the paper feed roller 9 makes contact with the sheet so as to feed the sheet. When the number of sheets which are set is equal to or less than the specified number, the feed position is the position of the uppermost sheet when the placement plate 73 (the paper feed roller 9) is raised to the upper limit position.

When before the raising of the placement plate 73 with the raising/lowering mechanism 8 is started, the second upper limit sensor S7 does not detect that the sheet is present in the feed position (no in step #12), the control unit 2 determines that the number of sheets loaded does not exceed the specified number (step #43). Then, the process proceeds to step S130. On the other hand, when before the raising of the placement plate 73 with the raising/lowering mechanism 8 is started, the second upper limit sensor S7 detects that the sheet is present in the feed position (no in step #42), the control unit 2 drives and rotates the paper feed roller 9 only for a predetermined time (step #44). In other words, when before the raising of the placement plate 73 is started by the raising/lowering mechanism 8, the second upper limit sensor S7 detects that the sheet is present in the feed position, the control unit 2 drives the paper feed roller 9.

The control unit 2 determines whether or not the sheet sensor S1 detects the sheet (step #45). When before the raising of the placement plate 73 is started, the sheet sensor S1 detects the sheet (yes in step #15), the control unit 2 determines that the number of sheets loaded exceeds the specified number (step #46).

In the case of yes in step #45, before the raising of the placement plate 73 is started, the sheet reaches the feed position. In other words, the sheets loaded on the placement plate 73 are brought into contact with the paper feed roller 9. Then, the control unit 2 stops the drive of the paper feed roller 9 (the paper feed motor 94) (step #47→end). The control unit 2 controls the raising/lowering mechanism 8 such that the raising of the placement plate 73 is prevented from being started. Then, the control unit 2 displays, on the display panel 41, a message indicting that the number of sheets loaded exceeds the specified number.

On the other hand, when before the raising of the placement plate 73 is started, the sheet sensor S1 does not detect the sheet (no in step #45), the sheet is not fed to the transport path (the transport unit 5*a*). Hence, the control unit 2 determines that the number of sheets loaded does not exceed the specified number (step #43). The raising/lowering mechanism 8 places the placement plate 73 on standby until an instruction (print data) to form an image is input to the printer 100. Then, by the reception of the instruction to form an image, the control unit 2 raises the placement plate 73 until the second upper limit sensor S7 detects the arrival of the sheet at the feed position (step #48). The control unit 2 makes the paper feed roller 9 feed the sheet from the placement plate 73. The control unit 2 makes the image formation unit 5*b* form the image on the sheet (step #→49 end).

(Second Variation)

Figure 14:
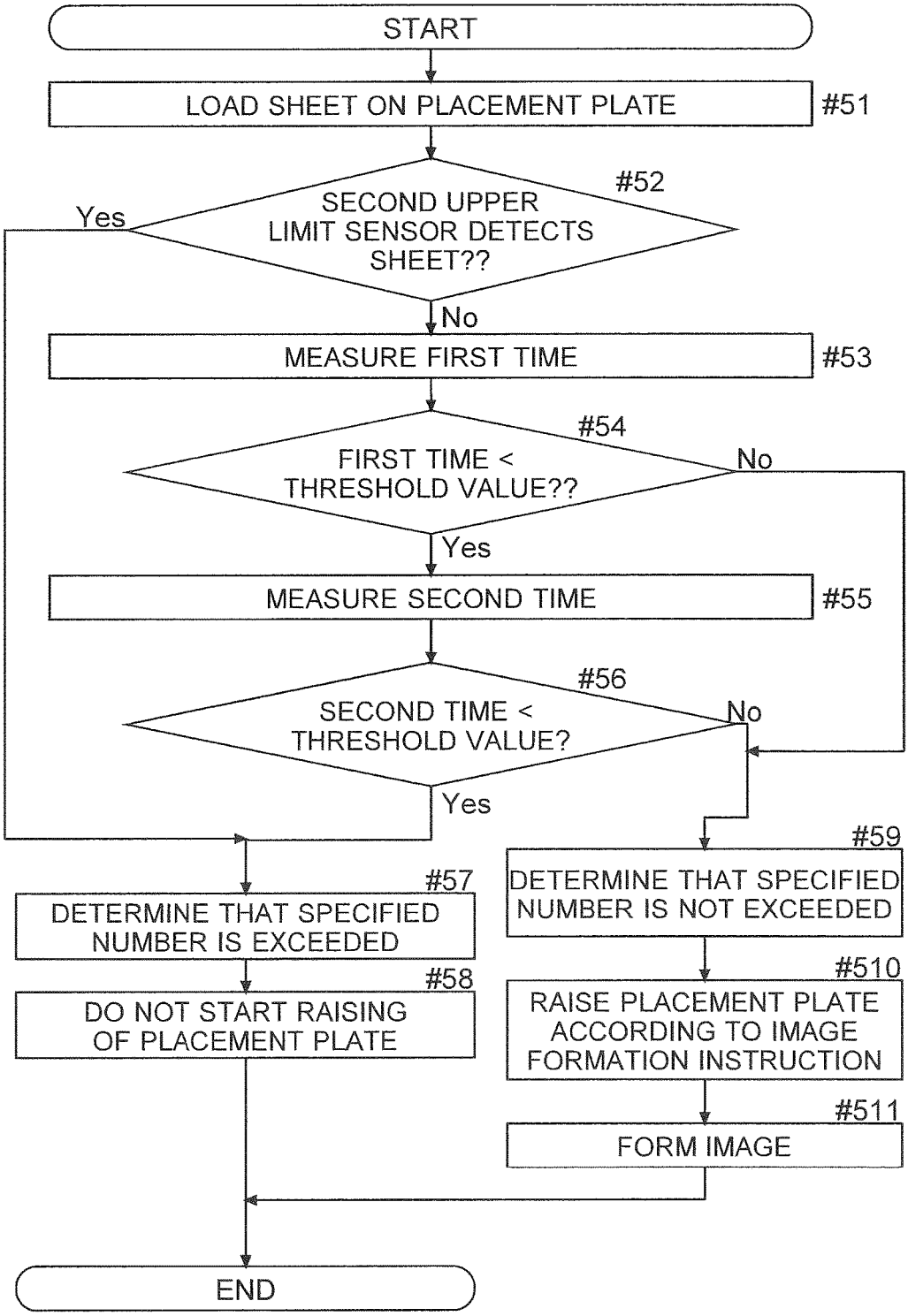

A paper feed device 1 (printer 100) according to a second variation of the present disclosure will then be described with reference to FIGS. 13 and 14. FIG. 14 is a flowchart showing an example of the flow of a determination as to whether or not a specified number in the second variation is exceeded. The configuration of the printer 100 according to the second variation is the same as the printer 100 described in the embodiment and the first variation. The paper feed device 1 according to the second variation performs steps #51 to #510 shown in FIG. 14. In this way, the control unit 2 determines whether or not the number of sheets loaded exceeds the specified number. The details of processing in step #51 is the same as the details of processing in step #41 of FIG. 13. Hence, the description thereof will be omitted. The details of processing in step #52 and the subsequent steps are as follows.

In step #52, the control unit 2 determines whether or not the second upper limit sensor S7 detects the sheet. When before the raising of the placement plate 73 with the raising/lowering mechanism 8 is started, the second upper limit sensor S7 detects that the sheet is present in the feed position (yes in step #52), the process proceeds to step #57. When before the raising of the placement plate 73 with the raising/lowering mechanism 8 is started, the second upper limit sensor S7 does not detect that the sheet is present in the feed position (no in step #52), the process proceeds to step #53.

The control unit 2 measures a first time (step #53). The first time is the time until the arrival of the sheet at the feed position is detected by the second upper limit sensor S7 after the control unit 2 makes the raising/lowering mechanism 8 start the raising of the placement plate 73. In other words, the control unit 2 measures the time until the second upper limit sensor S7 is turned on after the raising of the placement plate 73 from the lower limit position is started.

Then, the control unit 2 determines whether or not the first time is less than a threshold value (step #54). The threshold value is the first time when the number of sheets loaded is the specified number. When the number of sheets loaded is equal to or less than the specified number, the first time is equal to or more than the threshold value. When the number of sheets loaded exceeds the specified number, the first time is less than the threshold value.

Here, the threshold value will be described using a case where the specified number for the placement plate 73 is 500 sheets. For example, in a case where the first time when 500 sheets are loaded on the placement plate 73 is one second, the threshold value is one second. Hence, when the measured first time is 0.3 seconds, the first time is less than the threshold value. Consequently, the control unit 2 determines that the number of sheets loaded on the placement plate 73 exceeds the specified number. When the first time is 1.1 seconds, the first time exceeds the threshold value. Consequently, the control unit 2 determines that the number of sheets loaded on the placement plate 73 does not exceed the specified number.

When the first time is equal to or more than the threshold value (no in step #54), the process proceeds to step #59. On the other hand, when the first time is less than the threshold value (yes in step #54), the process proceeds to step #55. The control unit 2 controls the raising/lowering mechanism 8. The control unit 2 lowers the placement plate 73 to the lower limit position. The control unit 2 starts the raising of the placement plate 73 from the lower limit position. The control unit 2 measures a second time (step #55). The second time is the time until the arrival of the sheet at the feed position is detected by the second upper limit sensor S7 after the raising of the placement plate 73 from the lower limit position is started. After step #55, the control unit 2 makes the raising/lowering mechanism 8 lower the placement plate 73 to the lower limit position.

Then, the control unit 2 determines whether or not the second time is less than the threshold value (step #56). The second time when the number of sheets loaded is the specified number is the same as the threshold value (as with the first time). Hence, when the number of sheets loaded does not exceed the specified number, the second time is equal to or more than the threshold value. When the number of sheets loaded exceeds the specified number, the second time is less than the threshold value.

When the second time is less than the threshold value (yes in step #56), the control unit 2 determines that the number of sheets loaded on the placement plate 73 exceeds the specified number (step #57). Then, the control unit 2 controls the raising/lowering mechanism 8. The control unit 2 does not start the raising of the placement plate 73. The control unit 2 also does not drive the paper feed roller 9 (the paper feed motor 94) (step #58 →end). In other words, the control unit 2 stops the transport of the sheet. The control unit 2 displays, on the display panel 41, the message indicting that the number of sheets loaded exceeds the specified number.

When the first time is equal to or more than the threshold value (no in step #54) and the second time is equal to or more than the threshold value (no in step #56), the control unit 2 determines that the number of sheets loaded is equal to or less than the specified number (step #59). Then, the control unit 2 controls the raising/lowering mechanism 8. Specifically, the control unit 2 first lowers the placement plate 73 to the lower limit position. When an instruction to form an image on the sheet is received (when the print data is received), the control unit 2 raises the placement plate 73 (step #510). The control unit 2 raises the placement plate 73 until the second upper limit sensor S7 detects the arrival of the sheet at the feed position. Then, the control unit 2 makes the paper feed roller 9 feed the sheet which reaches the feed position. The control unit 2 makes the image formation unit 5*b* form the image on the sheet (step #511→end).

As described above, the image forming apparatus (printer 100) according to the embodiment includes the paper feed devices 1 (the paper feed device 1A, the paper feed device 1B and the paper feed device 1C), the print unit 5, the paper feed motor 94, the sheet sensor S1, the control unit 2 and the storage unit 3. The paper feed device 1 includes the cassette 71, the paper feed roller 9 and the raising/lowering mechanism 8. The cassette 71 includes the placement plate 73 on which the sheets are set, and can be opened by being removed. The paper feed roller 9 feeds out the sheet. The raising/lowering mechanism 8 raises and lowers the placement plate 73. The print unit 5 includes the image formation unit 5*b* which forms an image that is placed on the transported sheet. The print unit 5 transports the sheet supplied from the paper feed device 1 and ejects it to the ejection tray 51. The paper feed motor 94 rotates the paper feed roller 9. The sheet sensor S1 is provided in the transfer path of the sheet and detects the arrival and passage of the sheet. The control unit 2 controls the operations of the paper feed motor 94 and the paper feed devices 1. The control unit 2 recognizes, based on the output of the sheet sensor S1, that the sheet supplied from the paper feed device 1 reaches the installation position of the sheet sensor S1. The control unit 2 measures the measurement time which is the time until the sheet reaches the installation position after the rotation of the paper feed motor 94 is started. The storage unit 3 stores the determination time. The determination time is the time which is shorter than the reference time that is the time serving as the reference for the measurement time. The determination time is the time for determining whether or not the paper feed device 1 encounters overload in which the number of sheets set in the paper feed device 1 exceeds the upper limit. A plurality of paper feed devices 1 are stacked. The sheet sensor S1 is provided on the downstream side with respect to the uppermost paper feed device 1 in the sheet transport direction. The paper feed motor 94 rotates all the paper feed rollers 9. The storage unit 3 stores, for each of the paper feed devices 1, the determination time corresponding to the transport distance from the end portion of the set sheets on the downstream side to the sheet sensor S1. When the print job is performed, the control unit 2 selects, from among a plurality of paper feed devices 1, the paper feed source device which is the paper feed device 1 that supplies the sheets. The control unit 2 makes the raising/lowering mechanisms 8 of the paper feed devices 1 other than the paper feed source device keep the placement plates 73 in the lower limit position. The control unit 2 makes the raising/lowering mechanism 8 of the paper feed source device raise the placement plate 73 such that the uppermost sheet placed on the placement plate 73 of the paper feed source device is brought into contact with the paper feed roller 9 of the paper feed source device, and thereafter rotates the paper feed motor 94. Furthermore, when the measurement time is equal to or less than the determination time corresponding to the paper feed source device, the control unit 2 determines that the upper paper feed device 1 with respect to the paper feed source device encounters overload.

In this way, in the image forming apparatus in which all the paper feed rollers 9 are simultaneously rotated, it is possible to accurately determine the paper feed device 1 in which the sheets are excessively loaded. It is possible to determine the paper feed device 1 in which the paper feed roller 9 is in contact with the sheet in a state where the placement plate 73 is not raised. It is possible to determine that the paper feed device 1 is present which supplies the sheet though it is not necessary to do so. It is not necessary to provide a special sensor for detecting an overload state in each of the paper feed devices 1. It is possible to reduce an increase in the manufacturing cost.

When the paper feed device 1 is determined to encounter overload, the control unit 2 makes the raising/lowering mechanism 8 of the paper feed source device lower the placement plate 73. The control unit 2 makes the print unit 5 transport the sheet supplied from the overload paper feed device 1 to the ejection tray 51. In this way, it is possible to automatically eject the sheet supplied from the overload paper feed device 1 to the ejection tray 51 (the outside of the apparatus). The transport of the sheet itself is not stopped. Hence, it is not necessary to perform an operation for removing, from the transfer path, the sheet supplied from the overload paper feed device 1.

When the paper feed device 1 is determined to encounter overload, the control unit 2 rotates the paper feed motor 94 while making the raising/lowering mechanisms 8 of all the paper feed devices 1 keep the placement plates 73 in the lower limit position such that the sheet supplied from the overload paper feed device 1 is not fed. The control unit 2 makes the print unit 5 transport the sheet supplied from the overload paper feed device 1 to the ejection tray 51. In this way, all the placement plates 73 are brought into the lowered state. Then, it is possible to automatically reduce the sheets which are excessively loaded until the uppermost sheet is not brought into contact with the paper feed roller 9. It is possible to automatically eject the sheets which are excessively loaded. Hence, it is not necessary for the user to perform the operation. Consequently, it is possible to prevent the paper feed devices 1 which are not selected from feeding the sheets. It is possible to prevent the occurrence of a jam caused by the feeding of the sheets from a plurality of paper feed devices 1. It is possible to prevent the printing from being performed on the sheet of an unintended size fed from the overload paper feed device 1.

After the feeding of the sheet from the overload paper feed device 1 is stopped, the control unit 2 temporarily stops the paper feed motor 94. The control unit 2 makes the raising/lowering mechanism 8 of the paper feed source device raise the placement plate 73 to the upper limit position. The control unit 2 starts the rotation of the paper feed motor 94 so as to restart the feeding of the sheet. The control unit 2 makes the print unit 5 restart the printing. In this way, when the sheet is fed from the overload paper feed device 1, the print job is temporarily stopped. Then, it is possible to preferentially eject, from the overload paper feed device 1, the sheets which are excessively loaded. After the removal of the overload state, it is possible to automatically restart the print job. Hence, it is possible to continue the print job without any operation by the user.

When the paper feed motor 94 is rotated such that the sheet is prevented from being fed from the overload paper feed device 1, the control unit 2 rotates the paper feed roller 9 such that a space between the sheets is formed. In this way, the excessively loaded sheets can be appropriately ejected to the outside of the apparatus without colliding with each other.

The image forming apparatus includes the notification unit (the display panel 41 and the communication unit 6) and the open/close sensor S4. The notification unit notifies the message. The open/close sensor S4 detects the opening and closing of the cassette 71 in the paper feed device 1. Based on the output of the open/close sensor S4, the control unit 2 recognizes the opening and closing of the cassette 71 in the lowermost paper feed device 1. The control unit 2 detects the occurrence of a jam based on whether or not the time in which the presence of the sheet is detected by the sheet sensor S1 is equal to or more than the predetermined jam detection time. When after the opening or closing of the cassette 71 in the lowermost paper feed device 1, the occurrence of a jam is detected in the first print job in which the paper feed device 1 other than the lowermost paper feed device 1 is set to the paper feed source device, the control unit 2 makes the notification unit notify the warning message indicating that the lowermost paper feed device 1 may encounter overload. It is possible to determine whether or not the upper paper feed device 1 with respect to the paper feed source device encounters overload. With respect to the lowermost paper feed device 1, it is possible to indicate to the user that the lowermost paper feed device 1 may encounter overload. It is possible to prompt the user to remove the overload state of the lowermost paper feed device 1. Consequently, it is possible to prevent a jam from occurring and the printing from being performed on the sheet of an unintended size.

The reference time is the time which is obtained by dividing the transport distance from the end portion of the sheets set in the cassette 71 on the downstream side to the sheet sensor S1 by the design sheet transport speed. The determination time is the time which is obtained by subtracting the predetermined margin from the reference time. In this way, when the time until the sheet reaches the sheet sensor S1 after the rotation of the paper feed motor 94 is started is short such that its early arrival is caused by only an error, the corresponding paper feed device 1 is not detected to be the overload paper feed device 1. Thus, it is possible to prevent the erroneous detection of the overload paper feed device 1. Hence, the determination time can be set to an appropriate time.

The first variation is described with reference to FIGS. 12 and 13. In the first variation, before the raising of the placement plate 73 is started by the raising/lowering mechanism 8, the paper feed roller 9 is driven. Hence, when the number of sheets loaded on the placement plate 73 exceeds the specified number, the placement plate 73 is prevented from being raised. Then, the sheet is fed with the paper feed roller 9. Consequently, it is possible to detect that the number of sheets loaded on the placement plate 73 exceeds the specified number.

In the first variation, when before the raising of the placement plate 73 is started, the second upper limit sensor S7 detects that the sheet is located in the feed position, the paper feed roller 9 is driven. The sheets loaded on the placement plate 73 may be bent in a direction away from the placement plate 73. Even when such bending is caused, the paper feed roller 9 is driven, and thus it is possible to detect whether or not the number of sheets loaded exceeds the specified number. Consequently, it is possible to more accurately detect that the number of sheets loaded exceeds the specified number.

Furthermore, in the first variation, when before the raising of the placement plate 73 is started, the sheet sensor S1 detects the sheet, the drive of the paper feed roller 9 is stopped. Hence, when the number of sheets loaded exceeds the specified number, the transport of the sheet is stopped. Consequently, it is possible to remove the sheet from the printer 100 before the occurrence of a jam. The sheet is prevented from being removed after the occurrence of a jam. Thus, it is possible to prevent the sheet sensor S1 and the second upper limit sensor S7 from being damaged.

The control unit 2 controls the raising/lowering mechanism 8. In the first variation, when before the raising of the placement plate 73 is started, the sheet sensor S1 detects the sheet, the control unit 2 prevents the raising of the placement plate 73 from being started. Hence, the sheets which exceed the specified number are prevented from pressing the sheet sensor S1 by the raising of the placement plate 73. Consequently, it is possible to prevent the sheet sensor S1 from being damaged.

The control unit 2 controls the raising/lowering mechanism 8. In the first variation, when the number of sheets loaded exceeds the specified number, the control unit 2 prevents the raising of the placement plate 73 from being started. Hence, the sheets which exceed the specified number are prevented from pressing the paper feed roller 9. Consequently, it is possible to prevent the sheets on the placement plate 73 from being inclined with respect to the sheet transport direction by the pressing of the sheets with the paper feed roller 9.

Furthermore, even in the first variation, the paper feed rollers 9 are simultaneously rotated. The number of sheets loaded in the feed unit 3 which does not feed the sheet may exceed the specified number. In this case, before the raising of the placement plate 73 is started, it is possible to detect by the second upper limit sensor S7 or the sheet sensor S1 that the number of sheets loaded exceeds the specified number. Consequently, it is possible to prevent the sheet from being fed from the feed unit 3 which does not feed the sheet. It is possible to prevent the occurrence of a jam.

Furthermore, in the first variation, the control unit 2 controls the placement plate 73, the sheet sensor S1 and the second upper limit sensor S7. In this way, it is possible to detect that the number of sheets loaded exceeds the specified number. Hence, with a simple configuration, it is possible to detect that the number of sheets loaded exceeds the specified number.

Furthermore, in the first variation, the display panel 41 displays the message indicating that the number of sheets loaded exceeds the specified number. This message is different from the message indicating the occurrence of a jam in the printer 100. Hence, the user views the message displayed on the display panel 41. Here, the user unloads, from the placement plate 73, the sheets loaded on the placement plate 73. Consequently, it is possible to reduce the number of sheets loaded.

The second variation is described with reference to FIGS. 12 and 14. In the second variation, when before the raising of the placement plate 73 with the raising/lowering mechanism 8 is started, the second upper limit sensor S7 does not detect that the sheet is located in the feed position, the control unit 2 measures the first time. Hence, even when the second upper limit sensor S7 cannot detect that the specified number is exceeded, it is possible to detect whether or not the number of sheets loaded exceeds the specified number. Consequently, it is possible to more accurately detect that the number of sheets loaded exceeds the specified number.

In the second variation, when the first time is less than the threshold value, the control unit 2 measures the second time. When the sheets on the placement plate 73 are bent, the control unit 2 makes the raising/lowering mechanism 8 raise or lower the placement plate 73. Here, the sheets may be put along the placement plate 73 by their own weight. The bending of the sheets may be reduced. Consequently, even when the sheets are bent, it is possible to more accurately detect that the number of sheets loaded on the placement plate 73 exceeds the specified number.

Furthermore, in the second variation, when the first time is equal to or more than the threshold value, by the reception of the instruction to form an image on the sheet, the control unit 2 raises the placement plate 73. Hence, when the number of sheets loaded does not exceed the specified number, an image is formed on the sheet. Consequently, it is possible to prevent the occurrence of a jam when an image is formed.

Furthermore, in the second variation, when the first time is less than the threshold value but the second time is equal to or more than the threshold value, by the reception of the instruction to form an image on the sheet, the control unit 2 raises the placement plate 73. Hence, the transport of the sheet is prevented from being unnecessarily stopped. Consequently, an image is formed on the sheet. Hence, the convenience of the user is enhanced.

The embodiment and the variations of the present disclosure are described above with reference to the drawings (FIGS. 1 to 14). However, the present disclosure is not limited to the embodiment described above. The present disclosure can be practiced in various aspects without departing from the spirit thereof (for example, items (1) to (7) which will be described below). For ease of understanding, in the drawings, constituent elements are shown mainly and schematically. The thicknesses, the lengths, the numbers and the like of the constituent elements illustrated differ from the actual ones for convenience of the production of the drawings. The shapes, the dimensions and the like of the constituent elements described in the embodiment and the variations are examples. There are no particular limitations, and various modifications are possible without substantially departing from the effects of the present disclosure.

(1) The direction in which the cassette 71 is fitted and removed to and from the printer 100 may be perpendicular to the sheet transport direction. The direction may also be parallel to the sheet transport direction.

(2) The printer 100 includes the three feed units 3. The present disclosure is not limited to this configuration. For example, the printer 100 may include two feed units 3. The printer 100 may include a plurality of cassettes 71 which are equal to or more than four.

(3) The example where one sheet sensor S1 is provided is described. The present disclosure is not limited to this configuration. A plurality of sheet sensors S1 may be provided. For example, two sheet sensors S1 may be provided.

(4) The example where the second upper limit sensor S7 is provided on the inner wall of the cassette 71 is described. The present disclosure is not limited to this configuration. As long as it is possible to detect the arrival of the sheet at the feed position, the second upper limit sensor S7 may be provided outside the cassette 71. The second upper limit sensor S7 may be provided on the inner wall of the printer 100.

(5) The second upper limit sensor S7 includes the actuator. The present disclosure is not limited to this configuration. As long as the second upper limit sensor S7 detects that the sheet reaches the feed position, the second upper limit sensor S7 may be a transmission-type optical sensor. The second upper limit sensor S7 which is an optical sensor includes, for example, a light emission portion and a light reception portion. The light emission portion emits light toward the light reception portion. When the sheet is located in the feed position, the sheet interrupts the light emitted by the light emission portion toward the light reception portion. Hence, when the amount of light received and detected by the light reception portion is equal to or less than a threshold value, the second upper limit sensor S7 detects that the sheet is located in the feed position.

(6) In the second variation, when before the raising of the placement plate 73 with the raising/lowering mechanism 8 is started, the second upper limit sensor S7 detects that the sheet is located in the feed position, the control unit 2 may drive the paper feed roller 9 only for a predetermined time. Thereafter, the control unit 2 may measure the first time and/or the second time. For example, after step #45 in FIG. 13 is performed, steps #53 to #56 in FIG. 14 may be performed. After the first time and/or the second time is measured, the paper feed roller 9 may be driven only for a predetermined time. For example, after step #56 in FIG. 14 is performed, steps #44 and #45 in FIG. 13 may be performed.

What is claimed is:

1. An image forming apparatus comprising:

a plurality of paper feed devices which are stacked, each includes: a cassette that has a placement plate on which a sheet is set and that can be opened by being removed; a paper feed roller that feeds out the sheet; and a raising/lowering mechanism that raises and lowers the placement plate;

a paper feed motor which rotates the paper feed rollers;

a print unit which transports the sheet supplied and which performs printing on the transported sheet;

a sheet sensor which detects an arrival and a passage of the sheet and which is provided in a transfer path of the sheet;

a storage unit which stores a determination time that is a time for determining whether or not the paper feed device encounters overload in which a number of sheets set in the paper feed device exceeds an upper limit; and a control unit, wherein the control unit recognizes, based on an output of the sheet sensor, that the sheet supplied from the paper feed device reaches an installation position of the sheet sensor, and measures a measurement time that is a time until the sheet reaches the installation position after the rotation of the paper feed motor is started, the determination time is a time that is shorter than a reference time serving as a reference for the measurement time, the sheet sensor is provided on a downstream side with respect to an uppermost paper one of the paper feed devices uppermost paper feed device in a sheet transport direction, the paper feed motor rotates all the paper feed rollers, the storage unit stores, for each of the paper feed devices, the determination time corresponding to a transport distance from an end portion of the set sheet on the downstream side to the sheet sensor, when a print job is performed, the control unit selects, from among from the paper feed devices, a paper feed source device which is the paper feed device that feeds the sheet, makes the raising/lowering mechanisms of the paper feed devices other than the paper feed source device keep the placement plates in a lower limit position, makes the raising/lowering mechanism of the paper feed source device raise the placement plate such that an uppermost sheet placed on the placement plate of the paper feed source device is brought into contact with the paper feed roller of the paper feed source device, and thereafter rotates the paper feed motor and determines that an upper paper feed device with respect to the paper feed source device encounters the overload when the measurement time is equal to or less than the determination time corresponding to the paper feed source device, the reference time is a time which is obtained by dividing the transport distance from the end portion of the sheet set in the cassette on the downstream side to the sheet sensor by a design sheet transport speed, and the determination time is a time which is obtained by subtracting a predetermined margin from the reference time.

2. The image forming apparatus according to claim 1, wherein when the control unit determines that the paper feed device encounters the overload, the control unit makes the raising/lowering mechanism of the paper feed source device lower the placement plate, and makes the print unit transport the sheet supplied from the overload paper feed device to an ejection tray.

3. The image forming apparatus according to claim 1, wherein when the control unit determines that the paper feed device encounters the overload, the control unit makes the raising/lowering mechanisms of all the paper feed devices keep the placement plates in the lower limit position, rotates the paper feed motor such that the sheet is prevented from being fed from the overload paper feed device, and makes the print unit transport the sheet supplied from the overload paper feed device to an ejection tray.

4. The image forming apparatus according to claim 3, wherein the control unit temporarily stops the paper feed motor after the sheet is prevented from being fed from the overload paper feed device, makes the raising/lowering mechanism of the paper feed source device raise the placement plate to the upper limit position, starts the rotation of the paper feed motor so as to restart the feeding of the sheet and makes the print unit restart the printing.

5. The image forming apparatus according to claim 3, wherein when the control unit rotates the paper feed motor such that the sheet is prevented from being fed from the overload paper feed device, the control unit rotates the paper feed roller such that a space between the sheets is formed.

6. The image forming apparatus according to claim 1, further comprising:

a notification unit which notifies a message; and an open/close sensor which detects opening and closing of the cassette in the paper feed device, wherein the control unit recognizes, based on an output of the open/close sensor, the opening and closing of the cassette in a lowermost paper feed device, detects an occurrence of a jam based on whether or not a time in which the sheet sensor detects a presence of the sheet is equal to or more than a predetermined jam detection time and makes, when detecting the occurrence of the jam in a first print job in which after the opening or closing of the cassette in the lowermost paper feed device, the paper feed device other than the lowermost paper feed device is set to the paper feed source device, the notification unit notify a warning message indicating that the lowermost paper feed device may encounter the overload.

7. A method of controlling an image forming apparatus, the method comprising:

stacking a plurality of paper feed devices;

including a cassette that has a placement plate on which a sheet is set and that can be opened by being removed, a paper feed roller that feeds out the sheet and a lifting mechanism that raises and lowers the placement plate in each paper feed device;

making a paper feed motor rotating the paper feed rollers;

performing printing on the sheet which is supplied and transported;

using a sheet sensor so as to detect an arrival and a passage of the sheet;

storing a determination time;

the determination time being a time for determining whether or not a paper feed device encounters an overload in which a number of sheets set in the paper feed device exceeds an upper limit;

recognizing, based on an output of the sheet sensor, that the sheet supplied from a paper feed device reaches an installation position of the sheet sensor;

measuring a measurement time that is a time until the sheet reaches the installation position after the rotation of the paper feed motor is started;

the determination time being a time that is shorter than a reference time serving as a reference for the measurement time;

a plurality of the paper feed devices being stacked;

the sheet sensor being provided on a downstream side with respect to an uppermost paper one of the paper feed devices uppermost paper feed device in a sheet transport direction;

the paper feed motor rotating all the paper feed rollers;

storing, for each of the paper feed devices, the determination time corresponding to a transport distance from an end portion of the set sheet on the downstream side to the sheet sensor;

when a print job is performed, selecting, among from the paper feed devices, a paper feed source device which is the paper feed device that feeds the sheet;

making the raising/lowering mechanisms of the paper feed devices other than the paper feed source device keep the placement plates in a lower limit position;

making the raising/lowering mechanism of the paper feed source device raise the placement plate such that an uppermost sheet placed on the placement plate of the paper feed source device is brought into contact with the paper feed roller of the paper feed source device, and thereafter making the paper feed motor rotate; and determining that an upper paper feed device with respect to the paper feed source device encounters the overload when the measurement time is equal to or less than the determination time corresponding to the paper feed source device;

the reference time being a time which is obtained by dividing the transport distance from the end portion of the sheet set in the cassette on the downstream side to the sheet sensor by a design sheet transport speed; and the determination time being a time which is obtained by subtracting a predetermined margin from the reference time.

* * * * *